US009028281B2

(12) United States Patent
Kirk et al.

(10) Patent No.: US 9,028,281 B2
(45) Date of Patent: May 12, 2015

(54) HIGH PERFORMANCE, SMALL FORM FACTOR CONNECTOR

(75) Inventors: Brian Kirk, Amherst, NH (US); Vijay Kasturi, Hillsboro, OR (US)

(73) Assignee: Amphenol Corporation, Wallingford Center, CT (US)

( * ) Notice: Subject to any disclaimer, the term of this patent is extended or adjusted under 35 U.S.C. 154(b) by 287 days.

(21) Appl. No.: 13/509,411

(22) PCT Filed: Nov. 12, 2010

(86) PCT No.: PCT/US2010/056482

§ 371 (c)(1), (2), (4) Date: Sep. 24, 2012

(87) PCT Pub. No.: WO2011/060236

PCT Pub. Date: May 19, 2011

(65) Prior Publication Data

US 2013/0012038 A1 Jan. 10, 2013

Related U.S. Application Data

(60) Provisional application No. 61/260,962, filed on Nov. 13, 2009, provisional application No. 61/289,779, filed on Dec. 23, 2009, provisional application No. 61/289,768, filed on Dec. 23, 2009.

(51) Int. Cl.
*H01R 13/502* (2006.01)
*H01R 12/72* (2011.01)

(52) U.S. Cl.
CPC ..... *H01R 12/721* (2013.01); *H01R 12/724* (2013.01)

(58) Field of Classification Search
USPC ..... 439/701, 55, 325–329, 733.1, 108, 439/492–495, 607.07, 607.05, 607.11, 719, 439/188, 189, 660, 637, 79, 869
See application file for complete search history.

(56) References Cited

U.S. PATENT DOCUMENTS 2,996,710 A 8/1961 Pratt
3,002,162 A 9/1961 Garstang
(Continued)

FOREIGN PATENT DOCUMENTS

CN 101164204 A 4/2008
EP 1 779 472 A1 5/2007
(Continued)

OTHER PUBLICATIONS

U.S. Appl. No. 12/773,213, filed May 4, 2010, Atkinson et al.
(Continued)

*Primary Examiner* — Abdullah Riyami
*Assistant Examiner* — Harshad Patel
(74) *Attorney, Agent, or Firm* — Wolf, Greenfield & Sacks, P.C.

(57) ABSTRACT

Techniques for improving electrical performance of a connector. The techniques are compatible with the form factor of a standardized connector, such as an SFP connector or stacked SFP. The resulting connector has reduced insertion loss for high speed signals. Such techniques, which can be used separately or together, include shaping of conductive elements within the connector while still retaining the same mating contact arrangement. Changes may be made at the contact tail portions or in the intermediate portions where engagement to a connector housing occurs. The techniques also include the incorporation of lossy bridging members between conductive elements designated to be ground conductors. For connectors according to the stacked SFP configuration, multiple bridging members may be incorporated at multiple locations within the connector.

37 Claims, 17 Drawing Sheets

(56) References Cited

U.S. PATENT DOCUMENTS

| | | | | |
|---|---|---|---|---|
| 3,134,950 | A | 5/1964 | Cook | |
| 3,322,885 | A | 5/1967 | May et al. | |
| 3,786,372 | A | 1/1974 | Epis et al. | |
| 3,825,874 | A | 7/1974 | Peverill | |
| 3,863,181 | A | 1/1975 | Glance et al. | |
| 4,155,613 | A | 5/1979 | Brandeau | |
| 4,195,272 | A | 3/1980 | Boutros | |
| 4,276,523 | A | 6/1981 | Boutros et al. | |
| 4,371,742 | A | 2/1983 | Manly | |
| 4,408,255 | A | 10/1983 | Adkins | |
| 4,447,105 | A | 5/1984 | Ruehl | |
| 4,471,015 | A | 9/1984 | Ebneth et al. | |
| 4,484,159 | A | 11/1984 | Whitley | |
| 4,490,283 | A | 12/1984 | Kleiner | |
| 4,518,651 | A | 5/1985 | Wolfe, Jr. | |
| 4,519,664 | A | 5/1985 | Tillotson | |
| 4,519,665 | A | 5/1985 | Althouse et al. | |
| 4,636,752 | A | 1/1987 | Saito | |
| 4,682,129 | A | 7/1987 | Bakermans et al. | |
| 4,751,479 | A | 6/1988 | Parr | |
| 4,761,147 | A | 8/1988 | Gauthier | |
| 4,846,724 | A | 7/1989 | Sasaki et al. | |
| 4,878,155 | A | 10/1989 | Conley | |
| 4,948,922 | A | 8/1990 | Varadan et al. | |
| 4,970,354 | A | 11/1990 | Iwasa et al. | |
| 4,992,060 | A | 2/1991 | Meyer | |
| 5,000,700 | A | 3/1991 | Masubuchi et al. | |
| 5,141,454 | A | 8/1992 | Garrett et al. | |
| 5,150,086 | A | 9/1992 | Ito | |
| 5,168,252 | A | 12/1992 | Naito | |
| 5,168,432 | A | 12/1992 | Murphy et al. | |
| 5,266,055 | A | 11/1993 | Naito et al. | |
| 5,280,257 | A | 1/1994 | Cravens et al. | |
| 5,287,076 | A | 2/1994 | Johnescu et al. | |
| 5,340,334 | A | 8/1994 | Nguyen | |
| 5,346,410 | A | 9/1994 | Moore, Jr. | |
| 5,456,619 | A | 10/1995 | Belopolsky et al. | |
| 5,461,392 | A | 10/1995 | Mott et al. | |
| 5,499,935 | A | 3/1996 | Powell | |
| 5,551,893 | A | 9/1996 | Johnson | |
| 5,562,497 | A | 10/1996 | Yagi et al. | |
| 5,597,328 | A | 1/1997 | Mouissie | |
| 5,651,702 | A | 7/1997 | Hanning et al. | |
| 5,669,789 | A | 9/1997 | Law | |
| 5,796,323 | A | 8/1998 | Uchikoba et al. | |
| 5,831,491 | A | 11/1998 | Buer et al. | |
| 5,924,899 | A | 7/1999 | Paagman | |
| 5,981,869 | A | 11/1999 | Kroger | |
| 5,982,253 | A | 11/1999 | Perrin et al. | |
| 6,019,616 | A | 2/2000 | Yagi et al. | |
| 6,152,747 | A | 11/2000 | McNamara | |
| 6,168,469 | B1 | 1/2001 | Lu | |
| 6,174,203 | B1 | 1/2001 | Asao | |
| 6,174,944 | B1 | 1/2001 | Chiba et al. | |
| 6,217,372 | B1 | 4/2001 | Reed | |
| 6,299,483 | B1 | 10/2001 | Cohen et al. | |
| 6,347,962 | B1 | 2/2002 | Kline | |
| 6,350,134 | B1 | 2/2002 | Fogg et al. | |
| 6,361,374 | B1 * | 3/2002 | Lloyd et al. | 439/701 |
| 6,364,711 | B1 | 4/2002 | Berg et al. | |
| 6,375,510 | B2 | 4/2002 | Asao | |
| 6,379,188 | B1 | 4/2002 | Cohen et al. | |
| 6,398,588 | B1 | 6/2002 | Bickford | |
| 6,409,543 | B1 | 6/2002 | Astbury, Jr. et al. | |
| 6,482,017 | B1 | 11/2002 | Van Doorn | |
| 6,503,103 | B1 | 1/2003 | Cohen et al. | |
| 6,506,076 | B2 | 1/2003 | Cohen et al. | |
| 6,517,360 | B1 | 2/2003 | Cohen | |
| 6,530,790 | B1 | 3/2003 | McNamara et al. | |
| 6,537,087 | B2 | 3/2003 | McNamara et al. | |
| 6,554,647 | B1 | 4/2003 | Cohen et al. | |
| 6,565,387 | B2 | 5/2003 | Cohen | |
| 6,579,116 | B2 | 6/2003 | Brennan et al. | |
| 6,595,802 | B1 | 7/2003 | Watanabe et al. | |
| 6,602,095 | B2 | 8/2003 | Astbury, Jr. et al. | |
| 6,616,864 | B1 | 9/2003 | Jiang et al. | |
| 6,652,318 | B1 | 11/2003 | Winings et al. | |
| 6,655,966 | B2 | 12/2003 | Rothermel et al. | |
| 6,709,294 | B1 | 3/2004 | Cohen et al. | |
| 6,713,672 | B1 | 3/2004 | Stickney | |
| 6,743,057 | B2 * | 6/2004 | Davis et al. | 439/701 |
| 6,776,659 | B1 | 8/2004 | Stokoe et al. | |
| 6,786,771 | B2 | 9/2004 | Gailus | |
| 6,814,619 | B1 | 11/2004 | Stokoe et al. | |
| 6,872,085 | B1 | 3/2005 | Cohen et al. | |
| 6,926,565 | B2 * | 8/2005 | Fogg | 439/862 |
| 6,979,226 | B2 | 12/2005 | Otsu et al. | |
| 7,044,794 | B2 | 5/2006 | Consoli et al. | |
| 7,048,567 | B2 * | 5/2006 | Regnier et al. | 439/329 |
| 7,057,570 | B2 | 6/2006 | Irion, II et al. | |
| 7,074,086 | B2 | 7/2006 | Cohen et al. | |
| 7,094,102 | B2 | 8/2006 | Cohen et al. | |
| 7,108,556 | B2 | 9/2006 | Cohen et al. | |
| 7,163,421 | B1 | 1/2007 | Cohen et al. | |
| 7,285,018 | B2 | 10/2007 | Kenny et al. | |
| 7,335,063 | B2 | 2/2008 | Cohen et al. | |
| 7,371,117 | B2 | 5/2008 | Gailus | |
| 7,494,383 | B2 | 2/2009 | Cohen et al. | |
| 7,540,781 | B2 | 6/2009 | Kenny et al. | |
| 7,581,990 | B2 | 9/2009 | Kirk et al. | |
| 7,588,464 | B2 | 9/2009 | Kim | |
| 7,722,401 | B2 | 5/2010 | Kirk et al. | |
| 7,731,537 | B2 | 6/2010 | Amleshi et al. | |
| 7,753,731 | B2 | 7/2010 | Cohen et al. | |
| 7,771,233 | B2 | 8/2010 | Gailus | |
| 7,794,240 | B2 | 9/2010 | Cohen et al. | |
| 7,874,873 | B2 | 1/2011 | Do et al. | |
| 7,887,371 | B2 | 2/2011 | Kenny et al. | |
| 7,906,730 | B2 | 3/2011 | Atkinson et al. | |
| 7,914,304 | B2 | 3/2011 | Cartier et al. | |
| 8,083,553 | B2 | 12/2011 | Manter et al. | |
| 8,167,631 | B2 * | 5/2012 | Ito et al. | 439/108 |
| 8,182,289 | B2 | 5/2012 | Stokoe et al. | |
| 8,215,968 | B2 | 7/2012 | Cartier et al. | |
| 8,267,721 | B2 * | 9/2012 | Minich | 439/607.05 |
| 8,272,877 | B2 | 9/2012 | Stokoe et al. | |
| 8,371,875 | B2 | 2/2013 | Gailus | |
| 8,382,524 | B2 | 2/2013 | Khilchenko et al. | |
| 8,616,919 | B2 * | 12/2013 | Stoner | 439/607.07 |
| 8,657,627 | B2 | 2/2014 | McNamara et al. | |
| 8,771,016 | B2 | 7/2014 | Atkinson et al. | |
| 2001/0042632 | A1 | 11/2001 | Manov et al. | |
| 2002/0042223 | A1 | 4/2002 | Belopolsky et al. | |
| 2002/0089464 | A1 | 7/2002 | Joshi | |
| 2002/0098738 | A1 | 7/2002 | Astbury et al. | |
| 2002/0111068 | A1 | 8/2002 | Cohen et al. | |
| 2002/0111069 | A1 | 8/2002 | Astbury et al. | |
| 2004/0020674 | A1 | 2/2004 | McFadden et al. | |
| 2004/0115968 | A1 | 6/2004 | Cohen | |
| 2004/0121633 | A1 | 6/2004 | David et al. | |
| 2004/0121652 | A1 | 6/2004 | Gailus | |
| 2004/0196112 | A1 | 10/2004 | Welbon et al. | |
| 2004/0259419 | A1 | 12/2004 | Payne et al. | |
| 2005/0070160 | A1 | 3/2005 | Cohen et al. | |
| 2005/0133245 | A1 | 6/2005 | Katsuyama et al. | |
| 2005/0176835 | A1 | 8/2005 | Kobayashi et al. | |
| 2005/0283974 | A1 | 12/2005 | Richard et al. | |
| 2005/0287869 | A1 | 12/2005 | Kenny et al. | |
| 2006/0068640 | A1 | 3/2006 | Gailus | |
| 2007/0004282 | A1 | 1/2007 | Cohen et al. | |
| 2007/0021001 | A1 | 1/2007 | Laurx et al. | |
| 2007/0037419 | A1 | 2/2007 | Sparrowhawk | |
| 2007/0042639 | A1 | 2/2007 | Manter et al. | |
| 2007/0054554 | A1 | 3/2007 | Do et al. | |
| 2007/0059961 | A1 | 3/2007 | Cartier et al. | |
| 2007/0218765 | A1 | 9/2007 | Cohen et al. | |
| 2008/0194146 | A1 | 8/2008 | Gailus | |
| 2008/0246555 | A1 | 10/2008 | Kirk et al. | |
| 2008/0248658 | A1 | 10/2008 | Cohen et al. | |
| 2008/0248659 | A1 | 10/2008 | Cohen et al. | |
| 2008/0248660 | A1 | 10/2008 | Kirk et al. | |
| 2009/0011641 | A1 | 1/2009 | Cohen et al. | |
| 2009/0011645 | A1 | 1/2009 | Laurx et al. | |
| 2009/0051558 | A1 | 2/2009 | Dorval | |

(56) References Cited

U.S. PATENT DOCUMENTS

| | | | |
|---|---|---|---|
| 2009/0117386 | A1 | 5/2009 | Vacanti et al. |
| 2009/0239395 | A1 | 9/2009 | Cohen et al. |
| 2009/0291593 | A1 | 11/2009 | Atkinson et al. |
| 2010/0081302 | A1 | 4/2010 | Atkinson et al. |
| 2010/0294530 | A1 | 11/2010 | Atkinson et al. |
| 2011/0003509 | A1 | 1/2011 | Gailus |
| 2011/0230095 | A1 | 9/2011 | Atkinson et al. |
| 2011/0230096 | A1 | 9/2011 | Atkinson et al. |
| 2011/0287663 | A1 | 11/2011 | Gailus et al. |
| 2012/0094536 | A1 | 4/2012 | Khilchenko et al. |
| 2012/0156929 | A1 | 6/2012 | Manter et al. |
| 2012/0202363 | A1 | 8/2012 | McNamara et al. |
| 2012/0202386 | A1 | 8/2012 | McNamara et al. |
| 2013/0017733 | A1 | 1/2013 | Kirk et al. |
| 2013/0078870 | A1 | 3/2013 | Milbrand, Jr. |
| 2013/0109232 | A1 | 5/2013 | Paniaqua |
| 2013/0196553 | A1 | 8/2013 | Gailus |
| 2013/0225006 | A1 | 8/2013 | Khilchenko et al. |
| 2014/0004726 | A1 | 1/2014 | Cartier, Jr. et al. |
| 2014/0004746 | A1 | 1/2014 | Cartier, Jr. et al. |
| 2014/0057498 | A1 | 2/2014 | Cohen |

FOREIGN PATENT DOCUMENTS

| | | | |
|---|---|---|---|
| EP | 2 169 770 | A2 | 3/2010 |
| EP | 11166820.8 | | 1/2012 |
| GB | 1272347 | A | 4/1972 |
| JP | 07302649 | A | 11/1995 |
| WO | 88/05218 | A1 | 7/1988 |
| WO | 2004/059794 | A2 | 7/2004 |
| WO | 2004/059801 | A1 | 7/2004 |
| WO | PCT/US2005/034605 | | 1/2006 |
| WO | 2006/039277 | A1 | 4/2006 |
| WO | 2007/005597 | A2 | 1/2007 |
| WO | 2007/005599 | A1 | 1/2007 |
| WO | PCT/US06/25562 | | 10/2007 |
| WO | 2008/124057 | A1 | 10/2008 |
| WO | PCT/US2010/056482 | | 3/2011 |
| WO | PCT/US2011/034747 | | 7/2011 |
| WO | PCT/US2011/026139 | | 11/2011 |
| WO | PCT/US2011/026139 | | 9/2012 |
| WO | PCT/US2012/023689 | | 9/2012 |
| WO | PCT/US2012/060610 | | 3/2013 |
| WO | PCT/US2012/023689 | | 8/2013 |

OTHER PUBLICATIONS

U.S. Appl. No. 13/029,052, filed Feb. 16, 2011, Atkinson et al.
U.S. Appl. No. 13/034,670, filed Feb. 24, 2011, Atkinson et al.
U.S. Appl. No. 13/336,564, filed Dec. 23, 2011, Manter et al.
U.S. Appl. No. 13/365,203, filed Feb. 2, 2012, McNarama et al.
U.S. Appl. No. 13/509,452, filed Sep. 24, 2012, Kirk et al.
U.S. Appl. No. 13/654,065, filed Oct. 17, 2012, Paniaqua.
U.S. Appl. No. 13/683,295, filed Nov. 21, 2012, Milbrand, Jr.
U.S. Appl. No. 13/752,534, filed Jan. 29, 2013, Gailus et al.
U.S. Appl. No. 13/775,808, filed Feb. 25, 2013, Khilchenko et al.
U.S. Appl. No. 13/930,351, filed Jun. 28, 2013, Cartier Jr. et al.
U.S. Appl. No. 13/930,447, filed Jun. 28, 2013, Cartier Jr. et al.
U.S. Appl. No. 13/973,921, filed Aug. 22, 2013, Cohen.
International Preliminary Report on Patentability for International Application No. PCT/US2010/056482 mailed May 15, 2012.
Extended European Search Report for EP 11166820.8 mailed Jan. 24, 2012.
International Search Report with Written Opinion for International Application No. PCT/US06/25562 dated Oct. 31, 2007.
International Search Report and Written Opinion from PCT Application No. PCT/US2005/034605 dated Jan. 26, 2006.
International Search Report and Written Opinion for International Application No. PCT/US2010/056482 issued Mar. 14, 2011.
International Search Report and Written Opinionfor PCT/US2011/026139 dated Nov. 22, 2011.
International Preliminary Report on Patentability for PCT/US2011/026139 dated Sep. 7, 2012.
International Search Report and Written Opinion for International Application No. PCT/US2011/034747 dated Jul. 28, 2011.
PCT Search Report and Written Opinion for Application No. PCT/US2012/023689 mailed on Sep. 12, 2012.
International Preliminary Report on Patentability for Application No. PCT/US2012/023689 mailed on Aug. 15, 2013.
International Search Report and Written Opinion for PCT/US2012/060610 dated Mar. 29, 2013.
[No Author Listed] "Carbon Nanotubes For Electromagnetic Interference Shielding," SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013.
Beaman, High Performance Mainframe Computer Cables, Electronic Components and Technology Conference, 1997, pp. 911-917.
Shi et al, "Improving Signal Integrity In Circuit Boards By Incorporating Absorbing Materials," 2001 Proceedings. 51st Electronic Components and Technology Conference, Orlando FL. 2001:1451-56.

* cited by examiner

HIGH PERFORMANCE, SMALL FORM FACTOR CONNECTOR

CROSS REFERENCE TO RELATED APPLICATIONS

This application is a national stage of PCT/US2010/056482, filed Nov. 12, 2010, which claims priority to U.S. Provisional Application No. 61/260,962, filed Nov. 13, 2009; U.S. Provisional Application No. 61/289,768, filed Dec. 23, 2009; and U.S. Provisional Application No. 61/289,779, filed Dec. 23, 2009, which are incorporated herein by reference in their entirety.

FIELD OF THE INVENTION

This invention relates generally to electrical connectors and more specifically to electrical connectors adapted to receive cable plug assemblies.

RELATED TECHNOLOGY

Electronic systems are frequently manufactured from multiple interconnected assemblies. Electronic devices, such as computers, frequently contain electronic components attached to printed circuit boards. One or more printed circuit boards may be positioned within a rack or other support structure and interconnected so that data or other signals may be processed by the components on different printed circuit boards.

Frequently, interconnections between printed circuit boards are made using electrical connectors. To make such an interconnection, one electrical connector is attached to each printed circuit board to be connected, and those boards are positioned such that the connectors mate, creating signal paths between the boards. Signals can pass from board to board through the connectors, allowing electronic components on different printed circuit boards to work together. Use of connectors in this fashion facilitates assembly of complex devices because portions of the device can be manufactured on separate boards and then assembled. Use of connectors also facilitates maintenance of electronic devices because a board can be added to a system after it is assembled to add functionality or to replace a defective board.

Techniques for improving performance of electrical connectors are known. An example of such a technique is the incorporation of metallic shields. An example of shielding is shown in U.S. Pat. No. 6,709,294. Also, U.S. Pat. No. 7,074,086 discloses a conductive member that interconnects grounds, in the shape of shields, in a connector.

Another technique for improved high speed performance is the use of differential signals. Examples of differential electrical connectors are shown in U.S. Pat. No. 6,293,827, U.S. Pat. No. 6,503,103, U.S. Pat. No. 6,776,659, and U.S. Pat. No. 7,163,421, all of which are assigned to the assignee of the present application and are hereby incorporated by reference in their entireties.

Another technique involves the incorporation of lossy material into the connector. Examples of this technique may be found in U.S. Pat. No. 6,709,294, U.S. Pat. No. 6,786,771, U.S. Pat. No. 7,163,421, U.S. Pat. No. 7,335,063, U.S. Pat. No. 7,371,117, U.S. Pat. No. 7,494,383, U.S. Pat. No. 7,581,990, U.S. Pat. No. 7,771,233, U.S. Pat. No. 7,722,401 and U.S. Pat. No. 7,753,731.

In some instances, an electronic system is more complex or needs to span a wider area than can practically be achieved by assembling boards into a rack. It is known, though, to interconnect devices, which may be widely separated, using cables. A cable can be terminated with a cable connector, sometimes called a "plug," to make a separable connection to an electronic device. A printed circuit board within the electronic device may contain a board-mounted connector that receives the cable connector. However, rather than align with a connector on another board, the board-mounted connector is positioned near an opening in an exterior surface, sometimes referred to as a "panel," of the device. The cable connector may be plugged into the board-mounted connector through the opening in the panel, completing a connection between the cable and electronic components within the device.

An example of a board-mounted connector is the small form factor pluggable, or SFP, connector. SFP connectors have been standardized by an SFF working group and is documented in standard SFF 8431. That standard specifies the form factor and mating interfaces of the connector, such that board-mounted connectors manufactured according to the standard will mate with cable connectors according to the standard, regardless of the source of each. An SFP connector also has a standardized footprint such that a printed circuit board can be designed for attachment of a SFP connector from any source.

SUMMARY

Improved electrical performance of a connector is provided in a constrained form factor, such as a form factor defined by a connector standard. Improved performance may be achieved through the shaping of conductive elements within the connector designated to carry high speed signals. Alternatively or additionally, improved performance may be achieved through the use of one or more lossy members that couple conductive elements designated as ground conductors that are adjacent conductive elements designated to carry high speed signals.

In one aspect, the invention relates to an electrical connector with a bridging member. The connector has a housing with a front face, a rear face and a cavity with an opening in the front face shaped to receive a mating connector. The housing has a plurality of slots in the rear face, each of the plurality of slots opening into the cavity. The connector includes a plurality of conductive contact elements, each contact element having a contact tail, a mating portion and an intermediate portion connecting the contact tail and the mating portion. Each of the plurality of contact elements is positioned within the housing with the intermediate portion disposed within a slot of the plurality of slots and the mating portion projecting into the cavity. The bridging member is adjacent the rear face. The bridging member may be a lossy conductor and has a first portion contacting the intermediate portion of a first contact element of the plurality of contact elements and a second portion contacting the intermediate portion of a second contact element of the plurality of contact elements. The first contact element and the second contact element are separated by at least one other contact element of the plurality of contact elements that does not contact the bridging member.

In another aspect, the invention relates to an electronic assembly that includes a printed circuit board and an electrical connector with a bridging member mounted to the printed circuit board. The electrical connector has a housing with a lower surface, a front face and a rear face; and a cavity with an opening in the front face shaped to receive a mating connector. The connector is mounted to the printed circuit board with the lower surface adjacent the printed circuit board and the front face and the rear face extending perpendicular to the printed circuit board. the connector has a plurality of conductive contact elements, each of which has a contact tail connected to the printed circuit board, a mating portion and an intermediate portion connecting the contact tail and the mating portion. Each of the plurality of contact elements is positioned within the housing with the contact tail adjacent the lower surface and the mating portion projecting into the cavity. The bridging member is positioned adjacent the rear face. The bridging member may comprise lossy material and has a first portion contacting the intermediate portion of a first contact element of the plurality of contact elements and a second portion contacting the intermediate portion of a second contact element of the plurality of contact elements. The first contact element and the second contact element are separated by at least one other contact element of the plurality of contact elements that does not contact the bridging member.

In yet a further aspect, the invention relates to an electrical connector adapted for mounting to a planar substrate. The electrical connector has a housing with a cavity. The cavity is bounded by a lower surface and an upper surface, the lower surface being disposed to be closer to the substrate than the upper surface when the electrical connector is mounted to the substrate. The connector has a first plurality of conductive contact elements, each contact element having a contact tail adapted for attachment to the planar substrate, a mating portion extending through the lower surface of the cavity and an intermediate portion connecting the contact tail and the mating portion. The connector has a second plurality of conductive contact elements. Each of the second plurality of conductive contact elements has a contact tail adapted for attachment to the planar substrate, a mating portion extending through the upper surface of the cavity and an intermediate portion connecting the contact tail and the mating portion. The intermediate portion of the second plurality of contact elements has a first segment connected to the contact tail and extending perpendicularly to the planar substrate and a second segment connected to the mating portion extending parallel to the planar substrate. The bridging member interconnects multiple ones of the second plurality of conductive contact elements. The bridging member is a lossy conductor and connected to the intermediate portion of each of the interconnected ones of the second plurality of contact elements.

In one aspect, the invention relates to an electrical connector with a housing. A cavity with an opening in a front face of the housing is shaped to receive a mating connector. The housing has a plurality of slots in a rear face, each of the plurality of slots opening into the cavity. A plurality of conductive contact elements, are each positioned within the housing. Each contact element has a contact tail extending through a lower face of the housing, a mating portion and an intermediate portion connecting the contact tail and the mating portion. The contact elements are positioned with their intermediate portions in a slot and the mating portion projecting into the cavity. The intermediate portion of each contact element has a retention segment formed with a plurality of curved sub-segments. Each of the plurality of slots has a feature with a shape complementary to the retention segment of a contact element of the plurality of contact elements, and each of the plurality of contact elements is positioned in a slot of the plurality of slots with the retention segment disposed in the feature of the slot.

In another aspect, the invention relates to an electronic assembly, comprising a printed circuit board and a connector mounted to the printed circuit board. The connector has a housing a cavity with an opening in a front face of the housing. The cavity is shaped to receive a mating connector. The connector includes a plurality of conductive contact elements, each of which includes a contact tail, which extends through a lower face of the housing and is attached to the printed circuit board. Each contact element also has a mating portion and an intermediate portion connecting the contact tail and the mating portion. Each of the plurality of contact elements is positioned within the housing with the mating portion projecting into the cavity. For each of the plurality of contact elements, the intermediate portion comprises a first portion and a second portion, transverse to the first portion. The second portion is adjacent the mating portion. The width of the contact element being uniform over the first portion, but the contact element comprises a transition region between the first portion and the contact tail. The transition region includes a region over which the width of the contact element is less than the width in the first portion.

In yet a further aspect, the invention relates to an electrical connector. A housing of the connector has a front face with cavity with an opening shaped to receive a mating connector. There connector includes a plurality of contact elements, each contact element with a contact tail extending through a lower face of the housing, a mating portion and an L-shaped intermediate portion connecting the contact tail and the mating portion. The L-shaped intermediate portion comprises a first portion and a second portion, at a right angle relative to the first portion. The first portion of the intermediate portion of each contact element comprises a retention segment of uniform width. The retention segment includes a first sub-segment and a second sub-segment. The first sub-segment presses against a wall of a slot of the plurality of slots at a first angle relative a centerline of the intermediate portion, and the second sub-segment pressing against a wall of the slot at a second angle relative a centerline of the intermediate portion, the first angle being different than the second angle.

In some embodiments, a housing of the connector has a front face, a lower face and a cavity with an opening in the front face shaped to receive a mating connector. The connector has a plurality of conductive contact elements. Each contact element comprises a contact tail extending through the lower face, a mating portion and an intermediate portion connecting the contact tail and the mating portion. The plurality of contact elements are positioned in a row with the mating portion of each contact element in the row projecting into the cavity along a surface of the cavity. Contact elements in a first subset of the plurality of contact elements in the row each has a first width and Contact elements in a second subset of the plurality of contact elements in the row each has a second width, smaller than the first width. Contact elements in the second subset are disposed in a plurality of pairs; and two contact elements in the first subset are positioned adjacent each pair of contact elements in the second subset.

In some embodiments, a housing for the connector has a front face, a lower face and a cavity with an opening in the front face shaped to receive a mating connector. The connector also includes a plurality of conductive contact elements. Each contact element comprises a contact tail extending through the lower face, a mating portion and an intermediate portion connecting the contact tail and the mating portion. Each of the plurality of contact elements is positioned in a row with the mating portion of the contact element projecting into the cavity along a surface of the cavity. The contact elements in the row comprise a first subset and a second subset. Contact elements of the second subset are disposed in a plurality of pairs, and two contact elements of the of the first subset are positioned adjacent each pair of contacts of the second subset. The mating portions and the contact tails of the contact elements within the row are spaced on a uniform pitch. The intermediate portions of the plurality of contact elements are disposed within the row on a non-uniform pitch such that the intermediate portion of each contact element of the second subset in a pair of the plurality of pairs is closer to the intermediate portion of a contact element of first subset than to the intermediate portion of another contact element of the second subset in the pair.

In yet other embodiments, a housing for the connector has a front face, a lower face and a cavity with an opening in the front face shaped to receive a mating connector. The connector also has a plurality of conductive contact elements. Each contact element comprises a contact tail extending through the lower face, a mating portion; and an intermediate portion connecting the contact tail and the mating portion. Each of the plurality of contact elements is positioned in a row with the mating portion of the contact element projecting into the cavity along a surface of the cavity. The contact elements in the row comprise a first subset and a second subset. Contact elements of the second subset are disposed in a plurality of pairs. Two contact elements of the of the first subset are positioned adjacent each pair of contacts of the second subset. The mating portions of the contact elements within the row are spaced on a uniform pitch, and the intermediate portions of the plurality of contact elements are sized and positioned within the row such that each pair of the plurality of pairs provides a common mode impedance that is between 20 and 40 ohms.

The foregoing is a non-limiting summary of the invention, which is defined by the attached claims.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
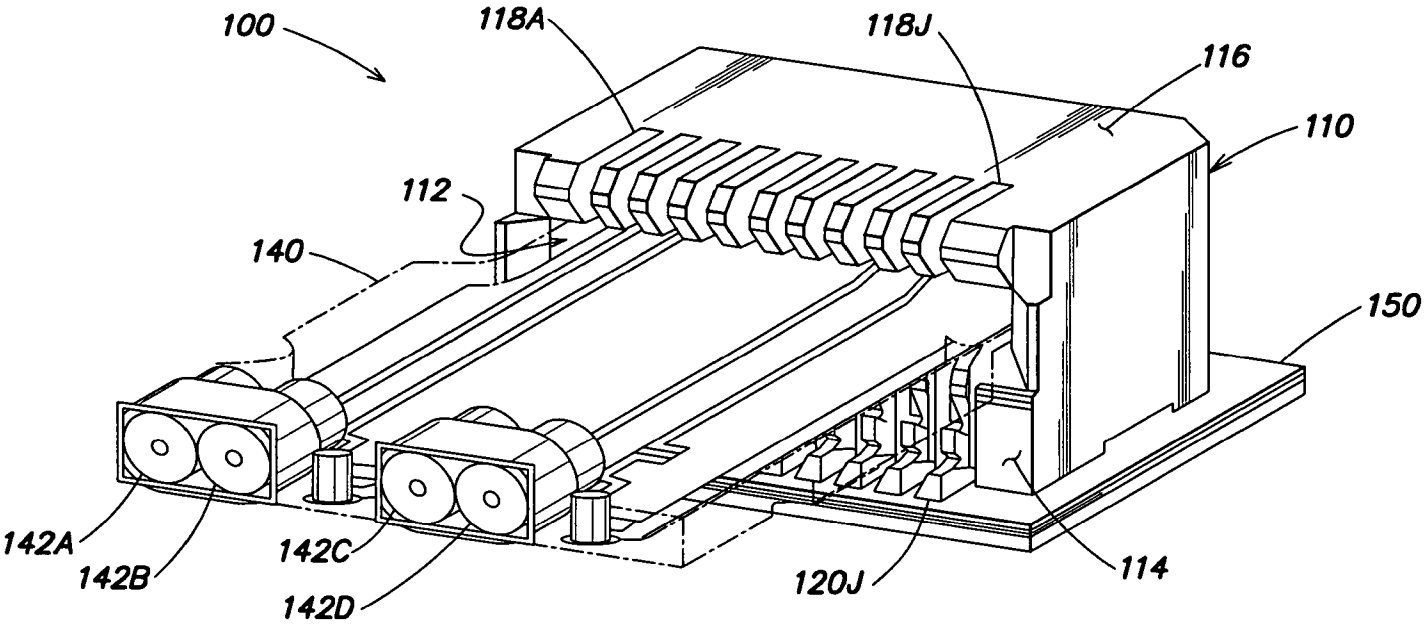
FIG. 1 (Prior Art)
FIG. 1 is a perspective view of an SFP board-mounted connector mated with a cable connector as is known in the art.

Applicants have recognized and appreciated that, though a standardized form factor for a connector provides many benefits, it can constrain design options, thereby limiting electrical performance of connectors made according to the standard. Applicants have recognized that improvements can be made to connector performance by appropriate selection of materials and shapes for elements of a connector. These improvements can be achieved even while staying within the form factor of standardized connectors, such as SFP connectors.

Such improvements may be used together, separately or in any suitable combination to increase the frequency range over which the connector may be used. Such techniques may be used to control various aspects of electrical performance, including the impedance of contact elements used to carry high speed signals within the connector. Changes may be made to provide pairs of signal contact elements that are designated as high speed signal conductors that have common mode and differential mode impedances that match other segments of the interconnection. For example, the differential mode impedance of high speed signal conductors may be approximately 100 ohms and the common mode impedance may be about 25 ohms to match the impedance characteristics of a printed circuit board to which the connector is attached. Though, in other embodiments, the common mode impedance may be of between 20 and 40 ohms. In some embodiments, the common mode impedance of the pairs may be between about 25 and 35 ohms or 30 and 35 ohms. As a specific example, the common mode impedance may be about 32 ohms, which may match the impedance of a cable through which signals are coupled to the connector. In other embodiments, the differential mode impedance of one or more pairs designated as high speed signal conductors may be other than 100 ohms, such as approximately 85 ohms to match some printed circuit boards. Even if the differential impedance is other than 100 ohms, the common mode impedance may still be about 32 ohms or other suitable value.

Alternatively or additionally techniques may be incorporated into the connector to control insertion loss. Such techniques may relate to shaping contact elements to provide a more uniform impedance along the length of the contact element. In some embodiments, attachment features used to hold the contact elements within a housing for a connector may be shaped to reduce insertion loss. In other aspects, transition regions may be incorporated into the contact elements to avoid changes in impedance where contact tails are attached to a printed circuit board.

Other improvements may reduce the effects of electrical resonances by altering the frequency of the electrical resonances or attenuating energy associated with the resonances. In some embodiments, resonances may be reduced through the incorporation of bridging members between ground contact elements. These bridging members may be positioned near the central portions of the contact elements acting as ground conductors. The bridging members may be constructed of conducting or partially conducting materials. These bridging members may be formed as part of the ground contact elements or may be formed as separate members that may be selectively attached to connectors after manufacture to adapt the connectors for high frequency operation.

Board-mounted SFP connectors are used as an example of a standardized connector that may be improved using some or all of the techniques described herein. These techniques may alter the high frequency performance of a connector, such as an SFP connector, without altering the form factor of the connector. As an example, the useful operating range of an SFP connector may be extended to above 16 Gigabits per second.

Prior to describing such techniques, SFP connectors as known in the art are described. FIG. 1 illustrates a single port, board-mounted connector 100 made according to the SFP standard. Connector 100 includes an insulative housing 110 and two rows of conductive contact elements (not visible). The contact elements have mating contact portions positioned within a cavity 112 in a front face 114 of connector housing 110.

In the configuration illustrated in FIG. 1, connector 100 is shown mated to a connector that terminates a cable. That connector includes a paddle card 140, which is shown inserted in cavity 112. Paddle card 140 may be constructed using known printed circuit board manufacturing techniques and may include conductive pads on its upper and lower surfaces. Those pads are positioned to align with the mating contact portions of the contact elements within connector 100.

Paddle card 140 may be attached to one or more cables, each cable containing cable conductors 142A, 142B, 142C and 142D in FIG. 1. Each of the cable conductors 142A . . . 142D may include a wire acting as a signal conductor. Each cable may also include one or more ground conductors. Each of the conductors may be attached to a conductive trace on paddle card 140 such that when paddle card 140 is inserted into mating cavity 112, a conductive contact element within connector 100 makes an electrical connection through paddle card 140 to the cable conductors 142A . . . 142D.

In use, connector 100 may be mounted to a printed circuit board 150, such as through soldering of contact tails associated with the contact elements to pads (not shown) on an upper surface of printed circuit board 150. FIG. 1 illustrates only a portion of printed circuit board 150. In an electronic device, printed circuit board 150 may be larger than illustrated in FIG. 1 and may contain other electronic components, including other connectors. In a typical installation, a connector 100 is mounted adjacent a panel of the electronic device. That panel may include an opening through which a cable connector, including a paddle card 140, is positioned for mating to connector 100.

Conductive contact elements within connector 100 are positioned with mating contact portions in two rows lining upper and lower surfaces of mating cavity 112. The upper row of conductive elements is not visible in FIG. 1. However, slots 118A . . . 118J (of which slots 118A and 118J are numbered) are visible in upper face 116 of housing 110. Slots 118A . . . 118J provide clearance for motion of the mating contact portions of the upper row of contact elements. Here, the mating contact portions are shaped as compliant beams that mate with the pads on the upper surface of paddle card 140.

A second row of contact elements lines a lower surface of mating cavity 112. The lower row of contact elements likewise includes mating contact portions shaped as beams. The contact elements contain contact tails extending from housing 110 for attachment to printed circuit board 150. In the view of FIG. 1, some of the contact tails from the lower row of contact elements, including contact tail 120J, are visible.

Figure 2:
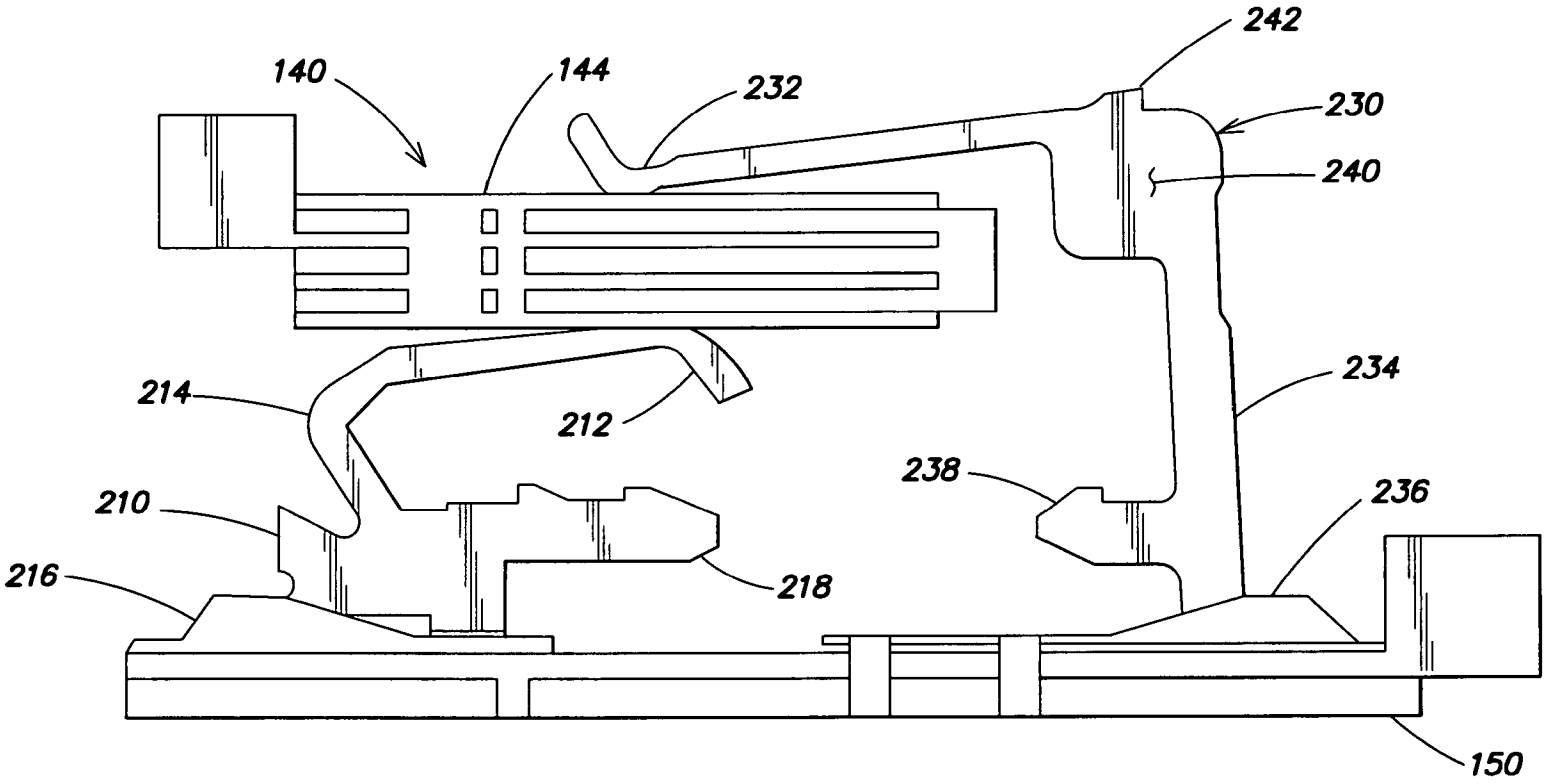
FIG. 2 (Prior Art)
FIG. 2 is a sketch illustrating contact elements within the connector of FIG. 1.

FIG. 2 shows in cross section the mating configuration of connector 100 with housing 110 cut away to expose contact elements. FIG. 2 illustrates a contact element 210 representative of contact elements in a row along the lower surface of mating cavity 112. FIG. 2 also illustrates a contact element 230, illustrative of contact elements in the row lining the upper surface of mating cavity 112. Contact element 210 includes a mating contact 212, shaped as a compliant beam. Likewise contact element 230 contains a mating contact 232, also shaped as a compliant beam. When a paddle card 140 is inserted into mating cavity 112, mating portion 212 presses against a conductive pad on the lower surface 146 of paddle card 140. Mating portion 232 presses against a conductive pad on upper surface 144 of paddle card 140.

Contact element 210 includes a contact tail 216 shaped for solder to a conductive pad on printed circuit board 150 using known surface mount soldering techniques. Likewise, contact element 230 includes a contact tail 236 shaped for soldering to printed circuit board 150. Though, other forms of contact tails are known, such as press fit contact tails, and any suitable shape of contact tail, whether now known or hereafter developed, may be used.

Contact element 210 includes an intermediate portion 214, providing an electrical connection between mating portion 212 and contact tail 216. Likewise, contact element 230 includes an intermediate portion 234, providing an electrical connection between mating portion 232 and contact tail 236. In addition to providing electrical connection between the mating portion and contact tail, the intermediate portions 214 and 234 provide attachment features for securing the contact elements to insulative housing 110 (FIG. 1). For this purpose contact element 210 includes a barb 218 extending from intermediate portion 214. When contact element 210 is pressed into housing 110, barb 218 enters a slot and engages housing 110 through an interference fit. Contact element 230 likewise includes barb 238 for attaching contact element 230 to insulative housing 110 (FIG. 1).

Other features of the contact elements are also visible in FIG. 2. For example, contact element 230 includes an enlarged region 240 providing mechanical strength for mating portion 232. Enlarged region 240 includes a barb 242, which provides a further attachment of contact element 232 housing 110.

In use inside an electronic device, connector 100 may be enclosed in a metal cage. The metal cage may serve multiple purposes, one of which is to reduce electromagnetic interference (EMI). Electromagnetic radiation from cable conductors 142A . . . 142D, paddle card 140 or connector 100 (FIG. 1) may disrupt operation of electronic components within an electronic device incorporating connector 100. By enclosing connector 100, the cable and the cable connector to which it mates in a cage, EMI may be reduced.

Figure 3A:
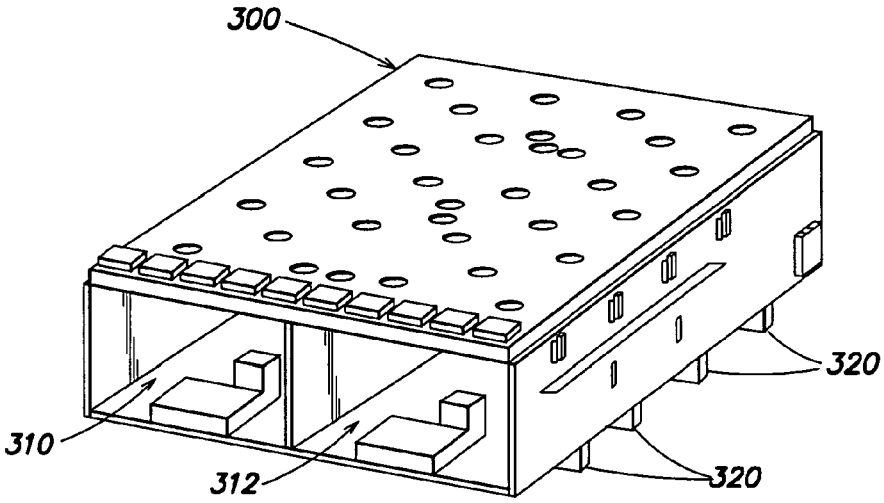
FIG. 3A (Prior Art)
FIG. 3A is a perspective view of a conducting cage that may be placed over two board-mounted connectors as illustrated in FIG. 1, allowing two cable connectors to be plugged into an electronic assembly.

FIG. 3A illustrates a cage 300, which may be stamped and formed from one or more sheets of metal. Cage 300 includes contact tails 320 extending from a lower edge of a side wall. Contact tails are shaped as press fit compliant members and are designed to be inserted into ground vias on a printed circuit board (not shown) to which cage 300 is attached.

In the embodiment illustrated, cage 300 is formed with two cavities 310 and 312. Each of the cavities 310 and 312 is shaped to enclose one board-mounted connector in the form of connector 100 and a corresponding cable connector to be mated with the connector 100. Though, it should be appreciated that a cage may be constructed to enclose any number of board-mounted connectors in the form of board connector 100 and cable connectors that may be plugged into those board-mounted connectors.

In the embodiment illustrated in FIG. 3A, the two board connectors are designed to be placed side by side near an edge of a printed circuit board. In this configuration, two cable connectors may be plugged into an electronic device in a side by side configuration.

Figure 3B:
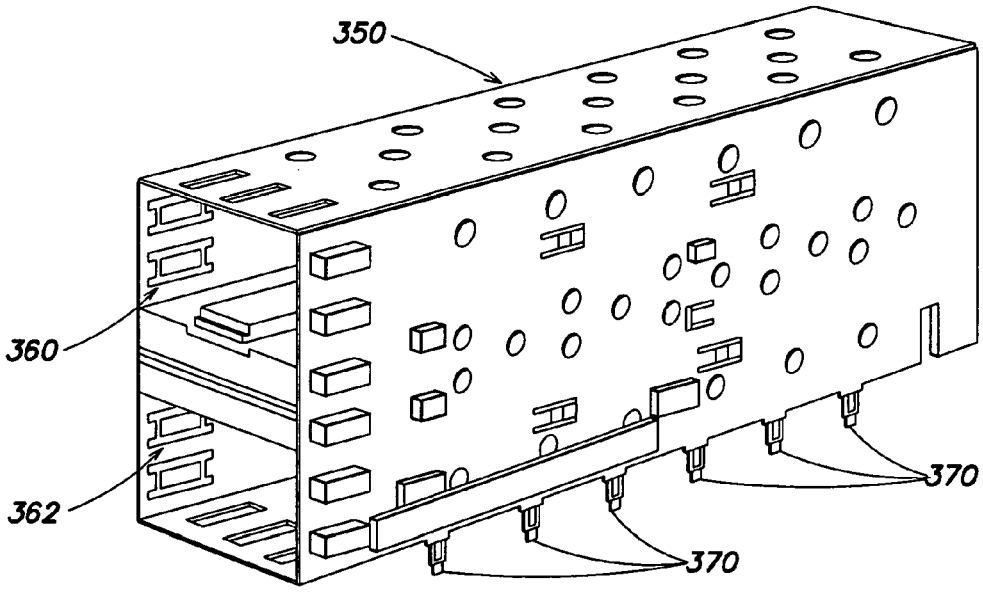
FIG. 3B (Prior Art)
FIG. 3B is a perspective view of a cage that may be placed over a stacked SFP connector, providing an alternative configuration for allowing two cable connectors to be plugged into an electronic assembly.

In some electronic devices, it is desirable for cables to be plugged into the device one above the other. Such a configuration is sometimes referred to as a "stacked" configuration. FIG. 3B illustrates a cage 350 that may be used in conjunction with a connector that supports this stacked configuration. Cage 350 includes contact tails 370 adapted for mounting cage 350 to a surface of a printed circuit board (not shown in FIG. 3B).

As can be seen from a comparison of FIGS. 3A and 3B, cage 350 contains cavities 360 and 362 aligned one above the other. Cage 350 may be used in conjunction with an SFP board-mounted connector in a stacked configuration. An SFP connector in a stacked configuration contains two rows of contact elements positioned to engage a cable connector inserted into cavity 360 and two rows of contact elements positioned to mate with a cable connector inserted into cavity 362.

Cage 350 may be manufactured using materials and techniques similar to those used to manufacture cage 300. For example, contact tails 370 are shaped as compliant press fit contacts that may be inserted into ground vias on a printed circuit board (not shown) to which cage 350 may be mounted.

Figure 4A:
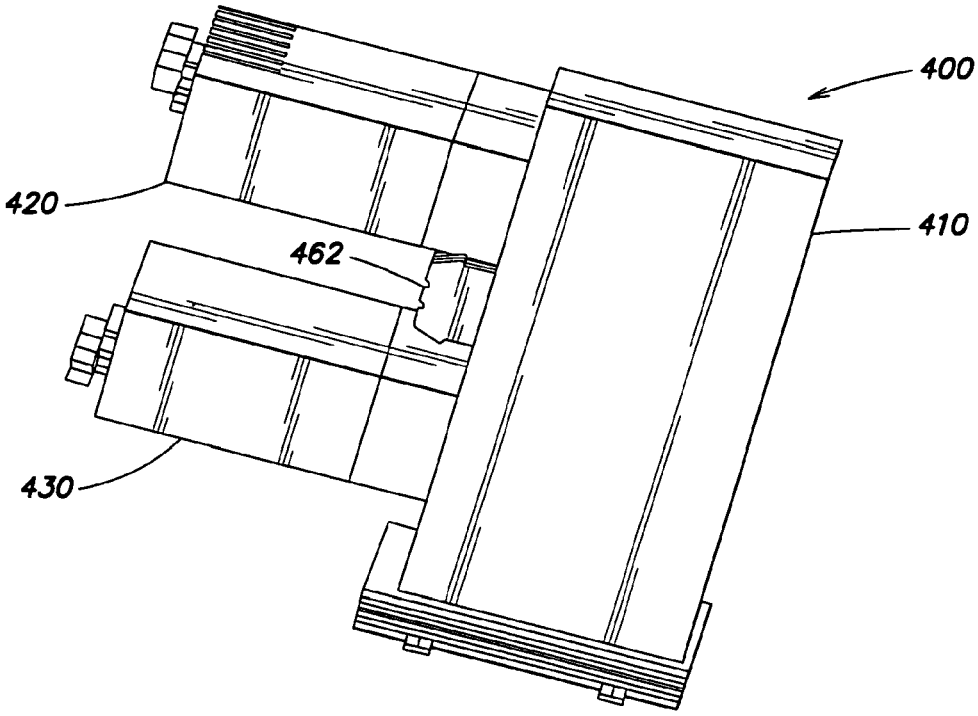
FIG. 4A (Prior Art)
FIG. 4A is a perspective view of a stacked SFP connector, as is known in the art.

FIG. 4A illustrates a stacked SFP connector 400 as is known in the art. FIG. 4A illustrates stacked SFP connector 400 mounted to printed circuit board 450. Stacked SFP connector 400 contains an upper port 420 and a lower port 430. Upper port 420 is shaped to fit within cavity 360 while lower port 430 is positioned to fit within cavity 362 of cage 350 (FIG. 3B). Upper port 420 contains a mating cavity having dimensions similar to mating cavity 112 (FIG. 1). This configuration allows a cable connector having the same form factor as illustrated in FIG. 1 to mate with stacked SFP connector through upper port 420.

Lower port 430 similarly includes a cavity in the same form as mating cavity 112 (FIG. 1). A row of contact elements lines each of the upper and lower surfaces of that cavity. A second cable connector in the form of the cable connector shown mated to connector 100 in FIG. 1, may mate with stacked SFP connector 400 through lower port 430.

Figure 4B:
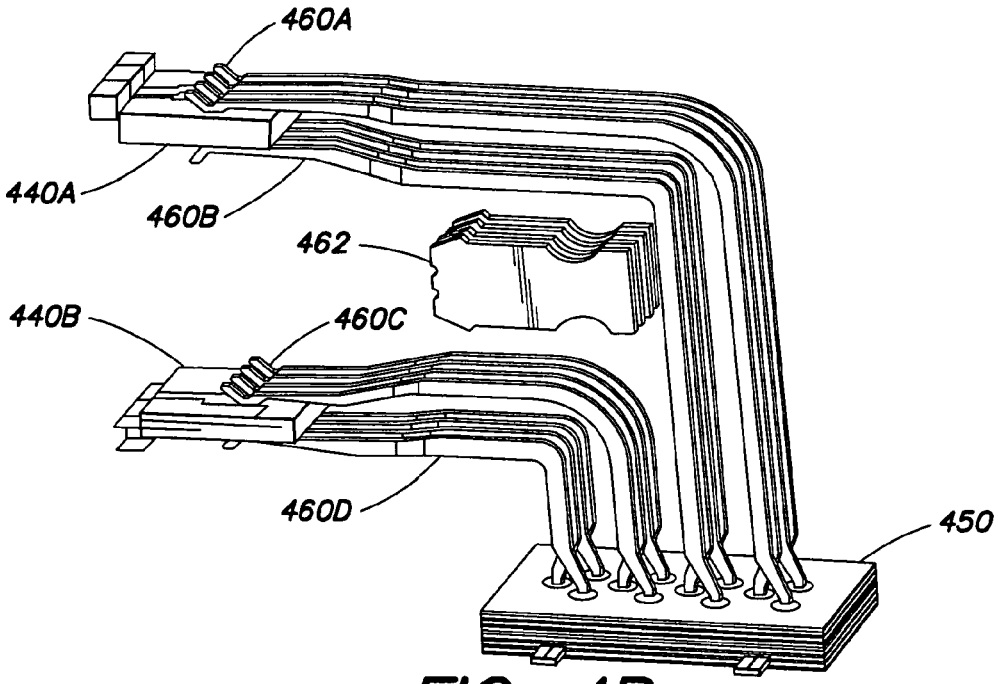
FIG. 4B (Prior Art)
FIG. 4B is a perspective view of contact elements within the stacked SFP connector of FIG. 4A with a housing of the connector cut away.

As a result, stacked SFP connector 400 provides four rows of contact elements. A portion of those four rows are illustrated in FIG. 4B. Row 460A is the upper row in upper port 420. Row 460B is the lower row of contact elements in upper port 420. Accordingly, when a paddle card 440A is inserted into upper port 420, contact elements in row 460A make contact to conductive paths on an upper surface of path 440A. Contact elements in row 460B make contact with paths on a lower surface of paddle card 440A.

Row 460C forms the upper row of contact elements in lower port 430. Row 460D forms the lower row of contact elements in lower port 430. Accordingly, when a paddle card 440B is inserted into lower port 430, contact elements in row 460C make contact with conductive paths on an upper surface of paddle card 440B. Conductive elements in row 460D make contact with conductive paths on a lower surface of paddle card 440B.

FIG. 4B illustrates four contact elements in each of the rows 460A . . . 460D. Four elements are shown for simplicity. In accordance with the SFP standard, each row contains ten contact elements. It should be appreciated that though inventive concepts described herein are illustrated as improvements to an SFP connector, the invention is not so limited, and the techniques described herein may be applied to improve electrical performance of any suitable connector.

In accordance with the SFP standard, some of the contact elements in stacked SFP connector 400 are designated to carry high speed signals while others are designated to be connected to grounds. Yet other contact elements are designated to carry low speed signals. Pairs of adjacent contact elements in rows 460A and 460D are designated to carry high speed differential signals. Contact elements adjacent the pairs are designated as ground conductors. Accordingly, the four contact elements shown in row 460D may represent a pair of contact elements designated to carry a differential signal and two ground contact elements. A similar designation of contact elements may occur in row 460A. For a row containing ten contact elements in total, six may be designated as signal contact elements, forming three pairs. The remaining contact elements may be designated as ground conductors.

FIG. 4B also illustrates a row of plates 462. As can be seen in FIG. 4A, plates 462 are positioned to extend from insulative housing 410 in a stacked SFP connector. Plates 462 may engage a cage, such as cage 350 (FIG. 3B) or other structure to which stacked SFP connector 400 may be attached.

Figure 5:
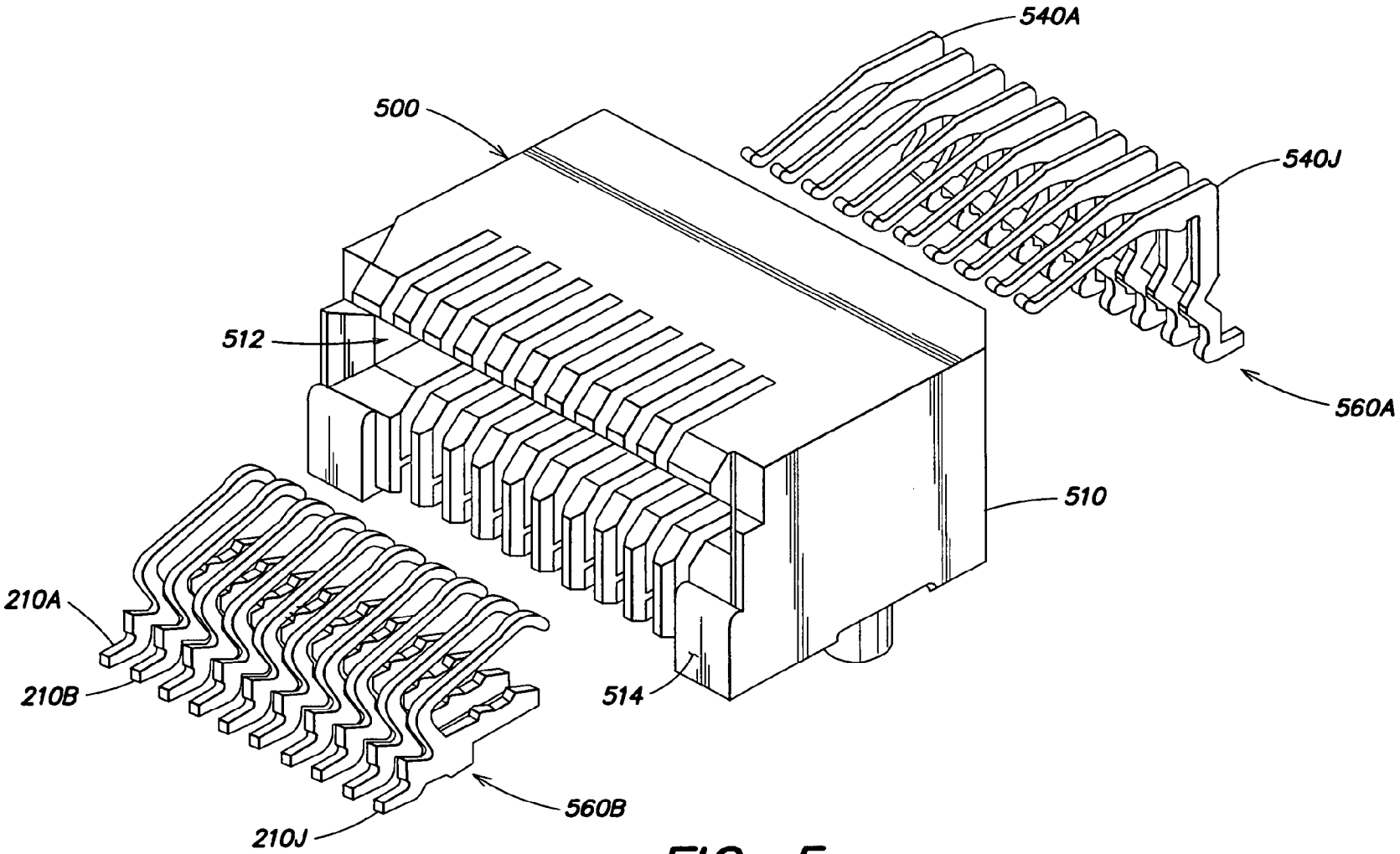
FIG. 5 is an exploded view of an SFP connector using contact elements shaped to improve electrical performance, according to some embodiments of the invention.

Turning to FIG. 5, an improved SFP connector 500 is illustrated. Here, connector 500 is a single port connector. SFP connector 500 has the same form factor as SFP connector 100 (FIG. 1) and therefore may mate with a paddle card 140 of standard design and may be attached to a printed circuit board with a footprint of a standard design. However, FIG. 5 includes contact elements shaped for high frequency operation.

As illustrated, connector 500 includes a housing 510. Housing 510 may be formed of an insulative material. For example, it may be molded from a dielectric material such as plastic or nylon. Examples of suitable materials are liquid crystal polymer (LCP), polyphenyline sulfide (PPS), high temperature nylon or polypropylene (PPO). Other suitable materials may be employed, as the present invention is not limited in this regard. All of these are suitable for use as binder materials in manufacturing connectors according to the invention. One or more fillers may be included in some or all of the binder material used to form housing 510 to control the electrical or mechanical properties of housing 510. For example, thermoplastic PPS filled to 30% by volume with glass fiber may be used.

As illustrated in FIG. 5, housing 510 may be shaped to provide a front face 514 having a shape like that of front face 114 on connector 100 (FIG. 1). Included in front face 514 is a mating cavity 512 shaped similarly to mating cavity 112 (FIG. 1).

Contact elements may be positioned within channels through the housing 510. In the embodiment illustrated, the channels have portions that are accessible through a surface of housing 510, creating slots into which the contact elements may be inserted. A row 560A of contact elements may be inserted into housing 510 from the rear to provide mating contact portions along an upper surface of mating cavity 512. A row 560B of contact elements may be inserted into housing 510 from the front to provide a row of mating contacts along a lower surface of mating cavity 512. Contact elements may be stamped from a sheet of conductive material such as phospher-bronze, a copper alloy or other suitable material. A suitable material may have a relatively high electrical conductivity and be sufficiently springy to form compliant beams that act as mating contacts. Suitable materials are known in the art and may be used, though any material having suitable electrical and mechanical properties may be used to form contact elements.

Some or all of the contact elements that make up rows 560A and 560B may be shaped for improved high frequency performance. In the embodiment illustrated in FIG. 5, the contacts in row 560A are shaped for high frequency performance while contact elements in row 560B are shaped as in a conventional SFP connector. In the embodiment illustrated, all of the contact elements in row 560A have the same shape, though not all may be designated for carrying high speed signals in the SFP standard. However, this configuration is illustrative and contact elements in either row 560A or 560B or in both rows 560A and 560B may be shaped to provide improved high frequency performance.

One technique illustrated in FIG. 5 for improving high frequency performance is removing or decreasing the size of attachment features for securing the contact elements within housing 510.

Figure 6:
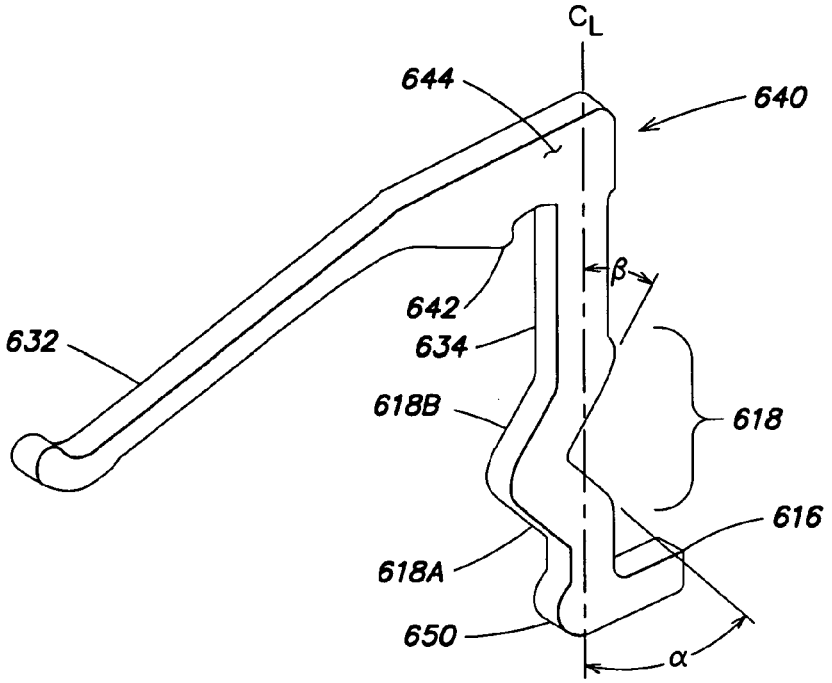
FIG. 6 is a perspective view of a contact element of the connector of FIG. 5.

In the embodiment illustrated, each of the contact elements, 540A . . . 540J, in row 560A has a similar shape. FIG. 6 illustrates a contact element 640 representative of the contact elements in row 560A. In the embodiment illustrated in FIG. 6, contact element 640 is L-shaped and includes a contact tail 616, a mating portion 632 and an intermediate portion 634. Here, mating portion 632 is shaped as a compliant beam, which generally has the same shape as mating portion 232 (FIG. 2) of a conventional SFP connector. Such a shape may be suitable for use in a connector having an SFP form factor, through a mating contact of any suitable shape may be used.

In the embodiment illustrated in FIG. 6, intermediate portion 634 has an retention segment 618. As can be seen from a comparison of contact element 640 and contact element 230 (FIG. 2), retention segment 618 takes the place of barb 238. Here, retention segment 618 contains two curved sub-segments 618A and 618B that bend away from and back towards the center line $C_L$ of the nominal position of intermediate portion 634. The retention segment, in the embodiment illustrated, may be said to be formed as a jog in the intermediate portion.

Despite the jog, retention segment 618 is generally the same width as in other portions of the intermediate portion 634. Such a shape provides a relatively uniform impedance to high frequency signals traveling along intermediate portion 634. Yet, as illustrated in the cross sectional view of FIG. 7, contact element 640 fits within housing 510. A connector 500 formed using contacts 640 therefore can conform to the SFP form factor.

Figure 7:
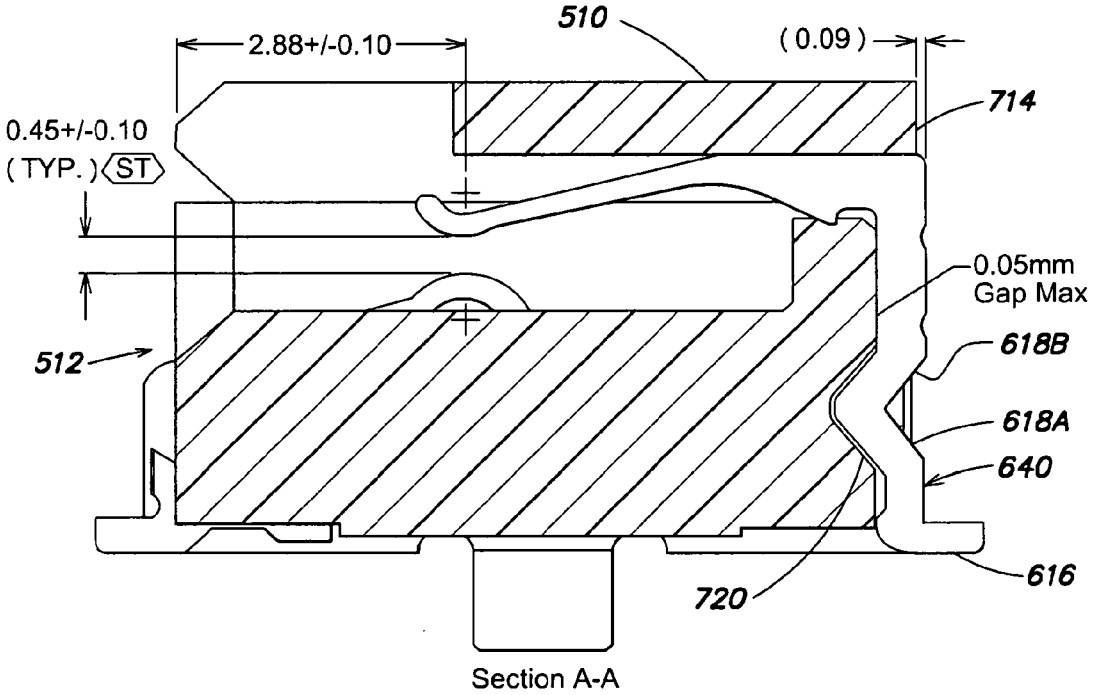
FIG. 7 is a cross-sectional view of the connector of FIG. 5.

As can be seen, the portion of the intermediate portion 634 that would be perpendicular to a printed circuit board when housing 510 is mounted to a printed circuit board is free of barbs or other projections for attachment. Despite the omission of a barb to engage housing 510, a contact element 640 is suitably retained within housing 510. In the embodiment illustrated in FIG. 7, attachment of contact 640 to housing 510 is achieved through a feature of housing 510 that has a shape complimentary to the shape of retention segment 618. As illustrated in the cross section of FIG. 7, contact element 640 is inserted into a slot, such as slot 918A (FIG. 9A), in rear face 714 of housing 510. Adjacent slot 918A is a concave region 720 that conforms to the generally convex shape of attachment region 618. Such complimentary features in contact element 640 and housing 510 provide positioning and retention of contact element 640. However, as can be seen in FIG. 7, intermediate portion 634 is generally of uniform width, and therefore uniform impedance, along its length, including within retention segment 618.

In the embodiment illustrated, sub-segment 618A makes an angle $\alpha$ (FIG. 6) relative to center line $C_L$. Sub-segment 618B makes an angle $\beta$ (FIG. 6) relative to center line $C_L$. The rear wall of a slot into which contact 640 is inserted has a corresponding shape such that the wall of the slot makes similar angles $\alpha$ and $\beta$ relative to center line $C_L$ and accordingly with rear face 714 of housing 510. Here the angles $\alpha$ and $\beta$ are generally of the same magnitude, though angle $\alpha$ extends in the opposite direction of angle $\beta$. In this example, angles $\alpha$ and $\beta$ are generally supplementary angles. This shaping aids in retaining a contact 640 within housing 510. Once contact tail 616 is soldered to a board, a force on the mating portion 632, which might tend to force contact 640 from housing 510, will create a moment about contact tail 616. This moment will be resisted as sub-segment 616A or 616B presses against a corresponding wall of the slot.

A further aspect of contact 640 (FIG. 6) is that the width of contact element 640 in transverse region 644 is also relatively uniform. This uniform width is achieved even though transverse region 644 is in the same relative position as enlarged region 240 (FIG. 2) in a conventional connector.

Also, contact element 640 includes a barb 642, which serves the same function as barb 242 (FIG. 2) of securing the contact element within an insulative housing. However, barb 642 is on a lower surface of transverse region 644. Though barb 642 effectively increases the width of some portions of transverse segment 644, it does so to a lesser extent than enlarged region 240 (FIG. 2). Moreover, the presence of barb 642 on the lower edge of transverse segment 644 avoids the need for a barb, such as barb 242 (FIG. 2) on an upper edge of transverse segment 644. In this way, the same region of contact element 640 is used both for attachment and to provide additional mechanical integrity at the base of the beam that forms mating portion 632. The net result of this configuration, in which barb 642 extends from an edge adjacent a perpendicular portion of intermediate portion 634 or is inside the angle of the L-shaped contact element, is that contact element 640 has a more uniform impedance profile along transverse segment 644, which can provide improved electrical performance.

Figure 8:
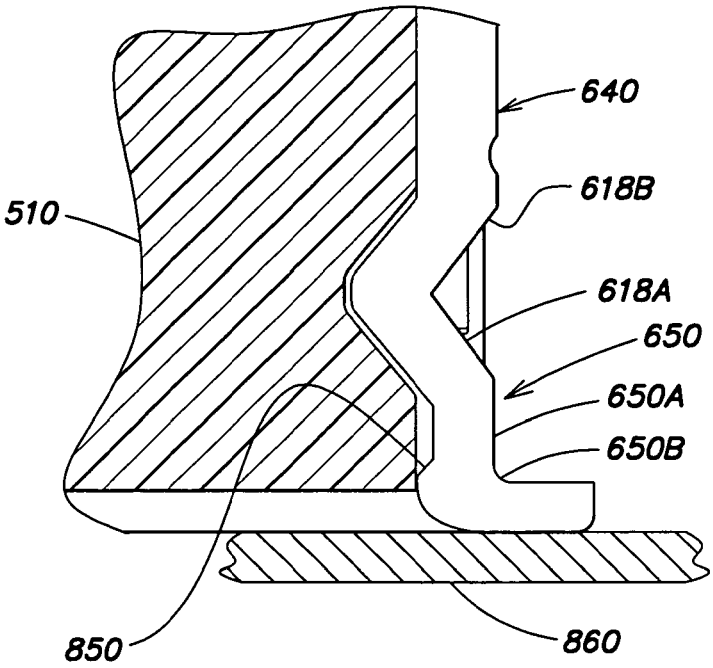
FIG. 8 is a cross-sectional view through a contact tail portion of a conductive element within the connector of FIG. 5.

Though a uniform width of contact element 644 is desirable in some segments, such as along intermediate portion 634 and along transverse segment 644, the inventors have recognized that a non-uniform width in other segments may be desirable. Another feature of contact element 640 may be a decreased width of contact element 640 along tail transition segment 650. Though this narrowing causes a localized increase in the inductive impedance along tail transition segment 650, when attached to a printed circuit board, contact tail 616 is likely to be attached to a pad and via, which has a higher capacitive impedance than intermediate portion 634 of contact element 640. By incorporating a tail transition segment 650 that is narrowed, the inductive impedance of the tail transition region offsets the capacitive impedance in the contact tail and board attachment. The net result of this shape is that the average impedance is relatively uniform through the interconnection system. FIG. 8 is an enlarged view of tail transition segment 650. As can be seen, tail transition segment 650 includes an outwardly tapering edge 850 of contact element 640 leading from a narrowed portion to a portion of the contact tail attached to a pad 850 on a surface of a printed circuit board (not shown).

As a result, contact element 640 includes a transition region 650. The width of contact element 640 at one point in this transition region, such as point 650A, is narrower than at a second point, such as point 650B. Because of the shape of tapering edge 850, the transition in width from point 650A to 650B is not abrupt, such that there is a gradual transition in impedance. Rather, there is a relatively uniform average impedance in which the inductive impedance of the narrowed transition region offsets increased capacitive impedance in the vicinity of pad 860.

Figure 9A:
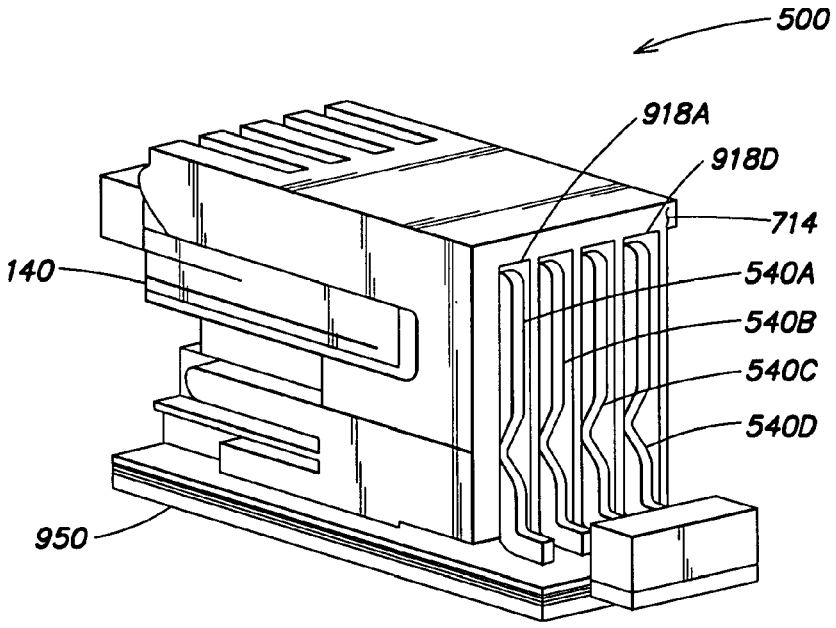
FIG. 9A is a perspective view of the connector of FIG. 5, with a portion partially cut away and the rear of the connector visible.
Figure 9B:
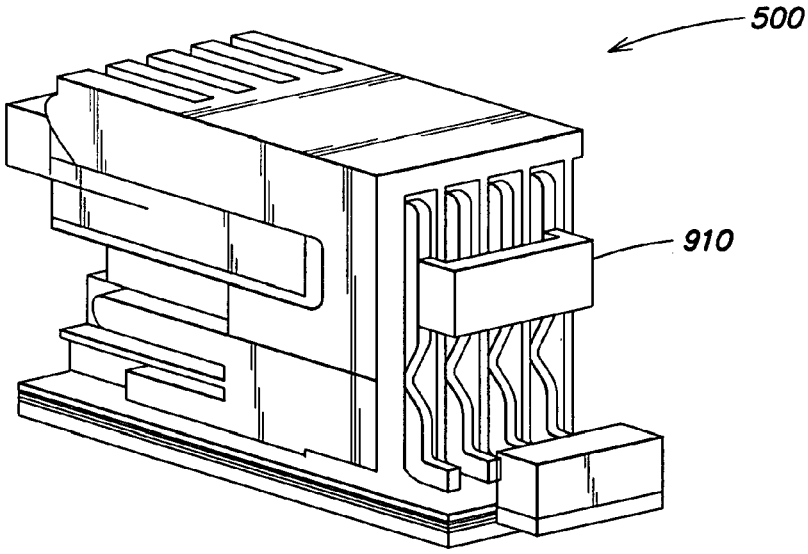
FIG. 9B is a perspective view of the connector of FIG. 5 with a portion partially cut away and the rear visible.

Other techniques may be employed in conjunction with a connector meeting the SFP form factor to provide improved electrical performance. FIGS. 9A and 9B illustrate a further technique that may be employed. In the embodiment illustrated in FIG. 9B, a bridging member may be applied to connector 500. A bridging member may provide a conductive or partially conductive path between contact elements designated to act as ground conductors. The ground conductors coupled through a bridging member may be adjacent ground conductors. In connectors with contact elements designated as signal and ground conductors in a pattern that facilitates routing of differential signals, a pair of adjacent contact elements may be designated as high speed signal conductors. A contact element on either side of this pair within a row may be designated as ground conductors. As a specific example, the bridging member may be connected to the contact elements designated as ground conductors adjacent two sides of a pair of high speed signal conductors within a row.

For example, contact elements 540B and 540C may be designated as high speed signal conductors. Contact elements 540A and 540D may be designated as ground conductors. In the embodiment illustrated, designation of a contact element as a signal or ground conductor does not impact the shape of the contact element. However, when connector 500 is attached to a printed circuit board 950, the contact tails associated with the signal conductors may be attached to high speed signal traces on printed circuit board 950 and the contact tails associated with ground conductors may be attached to ground structures within printed circuit board 950. The speed of high speed signals may be determined in any suitable way. In the example provided herein, high speed signals may be above 10 Gigabits per second or above 15 Gigabits per second. In other embodiments, the high speed signals may be approximately 17 Gigabits per second.

The inventors have recognized that providing a bridging element between contact elements, such as contact elements 540A and 540D, may improve the electrical performance of connector 500 by reducing or eliminating resonances within the frequency range of high speed signals. FIG. 9B illustrates connector 500 with a bridging member 910 attached. In the embodiment illustrated, bridging member 910 is electrically connected to contact elements 540A and 540D, which in this example embodiment are designated as ground conductors. Bridging member 910 is electrically isolated from other contact elements, including contact elements 540B and 540C, which in this example embodiment are designated as high speed signal conductors.

Bridging member 910 may be fully or partially conductive. By connecting such material near the central portion of ground conductors, bridging member 910 may reduce the effect of electrical resonance within connector 500. In some embodiments, bridging member 910 may reduce the impact of the resonance by changing the frequency at which the resonance occurs such that the resonant frequency is outside an intended operating range for a differential signal on contact elements 540B and 540C. Though, in some embodiments, a bridging member may dissipate resonant energy, which also reduces the effect of resonances.

Bridging member 910 may be attached to contact elements 540A and 540D at any suitable point along its length. In some embodiments, a greater improvement in performance may be achieved by making an electrical connection between bridging member 910 and contact elements 540A and 540D at approximately the midpoint of contact elements 540A and 540D. In some embodiments, bridging member 910 may be attached at a location in a central region of the intermediate portion of the contact elements. As an example, the central region may be approximately 25 to 75 percent of the linear distance along contact elements 540A and 540D as measured from printed circuit board 950 or, when the connector is not attached to a printed circuit board, as measured from the contact tail.

FIGS. 9A and 9B illustrate a portion of connector 500. For example, FIG. 5 illustrates row 560A contains ten contact elements 540A . . . 540J. Only a portion of connector 500, containing four contact elements, is illustrated in FIGS. 9A and 9B. For connectors with more than four contact elements, more than two contact elements may be designated as signal conductors. In embodiments in which a row contains more than one pair of signal conductors, there may be multiple pairs of signal conductors in that row, each pair having adjacent ground conductors. Accordingly, there may be multiple bridging members connecting ground conductors in the row.

Bridging member 910 may be formed of any suitable material and may be formed in any suitable way. In embodiments in which bridging member 910 is a conductive member, it may be formed of a piece of metal of the same type used to form contact elements 540A . . . 540D or other suitable conductive material. Though, in some embodiments, bridging member 910 may be formed of a lossy material.

Materials that conduct, but with some loss, over the frequency range of interest are referred to herein generally as "lossy" materials. Electrically lossy materials can be formed from lossy dielectric and/or lossy conductive materials. The frequency range of interest depends on the operating parameters of the system in which such a connector is used, but will generally be between about 1 GHz and 25 GHz, though higher frequencies or lower frequencies may be of interest in some applications. Some connector designs may have frequency ranges of interest that span only a portion of this range, such as 1 to 10 GHz or 3 to 15 GHz or 3 to 6 GHz.

Electrically lossy material can be formed from material traditionally regarded as dielectric materials, such as those that have an electric loss tangent greater than approximately 0.003 in the frequency range of interest. The "electric loss tangent" is the ratio of the imaginary part to the real part of the complex electrical permittivity of the material.

Electrically lossy materials can also be formed from materials that are generally thought of as conductors, but are either relatively poor conductors over the frequency range of interest, contain particles or regions that are sufficiently dispersed that they do not provide high conductivity or otherwise are prepared with properties that lead to a relatively weak bulk conductivity over the frequency range of interest. Electrically lossy materials typically have a conductivity of about 1 siemans/meter to about $6.1\times10^7$ siemans/meter, preferably about 1 siemans/meter to about $1\times10^7$ siemans/meter and most preferably about 1 siemans/meter to about 30,000 siemans/meter.

Electrically lossy materials may be partially conductive materials, such as those that have a surface resistivity between 1 Ω/square and $10^6$ Ω/square. In some embodiments, the electrically lossy material has a surface resistivity between 1 Ω/square and $10^3$ Ω/square. In some embodiments, the electrically lossy material has a surface resistivity between 10 Ω/square and 100 Ω/square. As a specific example, the material may have a surface resistivity of between about 20 Ω/square and 40 Ω/square.

In some embodiments, electrically lossy material is formed by adding to a binder a filler that contains conductive particles. Examples of conductive particles that may be used as a filler to form an electrically lossy material include carbon or graphite formed as fibers, flakes or other particles. Metal in the form of powder, flakes, fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers, such as carbon flake. In some embodiments, the conductive particles disposed in bridging member 910 may be disposed generally evenly throughout, rendering a conductivity of the lossy portion generally constant. In other embodiments, a first region of bridging member 910 may be more conductive than a second region of bridging member 910 so that the conductivity, and therefore amount of loss within bridging member 910 may vary.

The binder or matrix may be any material that will set, cure or can otherwise be used to position the filler material. In some embodiments, the binder may be a thermoplastic material such as is traditionally used in the manufacture of electrical connectors to facilitate the molding of the electrically lossy material into the desired shapes and locations as part of the manufacture of the electrical connector. However, many alternative forms of binder materials may be used. Curable materials, such as epoxies, can serve as a binder. Alternatively, materials such as thermosetting resins or adhesives may be used. Also, while the above described binder materials may be used to create an electrically lossy material by forming a binder around conducting particle fillers, the invention is not so limited. For example, conducting particles may be impregnated into a formed matrix material or may be coated onto a formed matrix material, such as by applying a conductive coating to a plastic housing. As used herein, the term "binder" encompasses a material that encapsulates the filler, is impregnated with the filler or otherwise serves as a substrate to hold the filler.

Preferably, the fillers will be present in a sufficient volume percentage to allow conducting paths to be created from particle to particle. For example, when metal fiber is used, the fiber may be present in about 3% to 40% by volume. The amount of filler may impact the conducting properties of the material.

Filled materials may be purchased commercially, such as materials sold under the trade name Celestran® by Ticona. A lossy material, such as lossy conductive carbon filled adhesive perform, such as those sold by Techfilm of Billerica, Mass., US may also be used. This perform can include an epoxy binder filled with carbon particles. The binder surrounds carbon particles, which acts as a reinforcement for the perform. Such a perform may be shaped to form all or part of bridging member 910 and may be positioned to adhere to ground conductors in the connector. In some embodiments, the perform may adhere through the adhesive in the perform, which may be cured in a heat treating process. Various forms of reinforcing fiber, in woven or non-woven form, coated or non-coated may be used. Non-woven carbon fiber is one suitable material. Other suitable materials, such as custom blends as sold by RTP Company, can be employed, as the present invention is not limited in this respect.

In some embodiments, bridging member 910 may incorporate both lossy and insulative materials. Such a construction may be formed by over molding a binder having insulative fillers on a structure formed by molding a binder with conductive fillers, or vice versa. By incorporating insulative portions in bridging member 910, the insulative portions of bridging member 910 may contact signal conductors 540B and 540C without impacting their performance.

Regardless of how bridging member 910 is formed, bridging member 910 may be selectively attached to some contact elements in any suitable way. Attachment features may be incorporated in bridging member 910 or may be incorporated in contact elements, such as contact elements 540A and 540D. As one example, in an embodiment in which bridging member 910 is molded of a lossy material, contact elements 540A and 540D may contain barbs or other projections onto which bridging member 910 may be pressed. Alternatively, bridging member 910 may be formed with projections or other attachment features that clip to contact elements 940A and 940D or that press against contact elements 940A and 940D when inserted into slots 918A and 918D. As a further example, bridging member 910 may be integrally formed with either or both of contact elements 940A and 940D.

Figure 10:
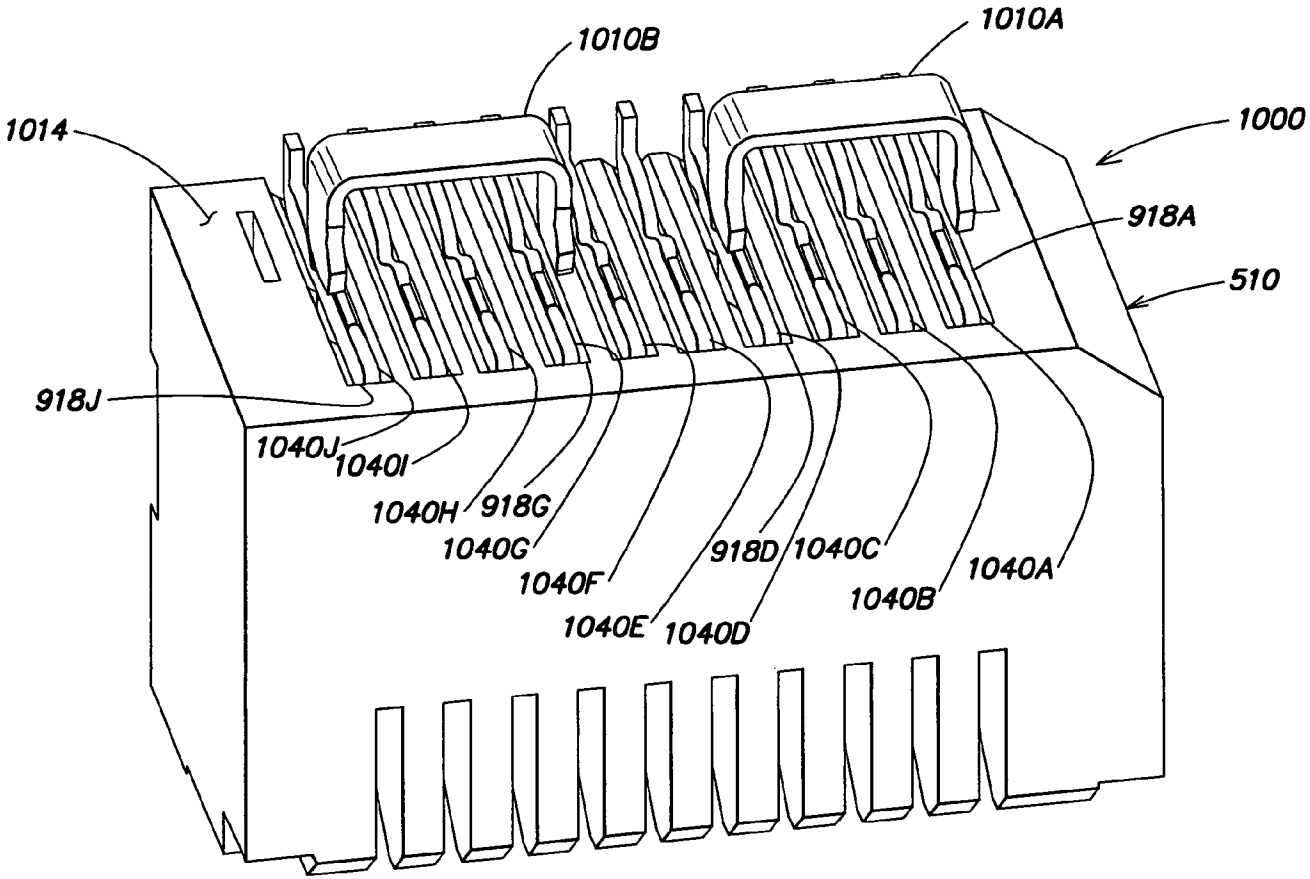
FIG. 10 is a perspective view of an SFP connector with the top and rear visible, according to some embodiments of the invention.

FIG. 10 illustrates an embodiment of a connector 1000 in which bridging members are formed of a conductive material and are integrally formed with a contact element. In the example of FIG. 10, rear face 1014 of connector 1000 is visible. Connector 1000 may employ a housing 510 as in the embodiment illustrated in FIG. 5. Ten contact elements 1040A . . . 1040J are illustrated. In the embodiment of FIG. 10, contact elements 1040B and 1040C are designated as signal conductors in a pair suitable for carrying high speed differential signals. Likewise, contact elements 1040H and 1040I are designated as a pair of signal conductors. Contact elements 1040A and 1040D, which are adjacent the pair formed by contact elements 1040B and 1040C, are designated as ground conductors. Likewise contact elements 1040G and 1040J are designated as ground conductors and are adjacent the pair formed by contact elements 1040H and 1040I.

In the example of FIG. 10, bridging element 1010A electrically connects contact elements 1040D and 1040A. Bridging member 1010B electrically connects contact elements 1040G and 1040J. Bridging members 1010A and 1010B are, in the example of FIG. 10, integrally formed with one of the contact elements designated as a ground conductor. As illustrated, bridging member 1010A is integrally formed with contact element 1040D and bridging member 1010B is integrally formed with contact element 1040J. Bridging member 1010A and contact element 1040D may, for example, be stamped from a single sheet of metal and then formed to contain a U shaped portion to serve as bridging member 1010A. Contact elements 1040J and 1010B may be formed in a similar fashion.

Bridging member 1010A may be formed with a terminal portion that extends into slot 918A when contact element 1040D is inserted into slot 918D. The terminal portion of bridging member 1010A may be pressed against contact element 1040A, thereby making an electrical connection. Bridging member 1010B may likewise contain a terminal portion that, when inserted in slot 918G, presses again contact element 1040G. Though, in other embodiments, bridging member 1010A may be stamped from the same sheet of metal as contact elements 1040A and 1040D, which are to be coupled through the bridging member. Both contact elements, with the bridging member already attached may be inserted into housing 510 after contact elements 1040B and 1040C are inserted. Such a unitary construction may avoid the need for separate connections between a bridging member, such as 1010A and 1010B, and any of the contact elements.

Because bridging members 1010A and 1010B need not provide highly conductive paths between adjacent ground conductors, many approached for forming an electrical connection between the bridging members and ground conductors will be suitable. For example, in some embodiments, direct contact may not be required. Rather, a suitable connection may be made by placing a portion of the bridging member close enough to the ground conductor that a capacitive coupling is formed.

In the embodiment illustrated, contact elements 1040E and 1040F are designated as low speed conductors according to the SFP standard and may carry low speed signals, power or ground. However, in some embodiments, contact elements 1040E and 1040F may serve as signal conductors, forming a pair suitable for carrying a high speed differential signal. Contact elements 1040E and 1040F are positioned between contact elements 1040D and 1040G, which, in the example of FIG. 10 are designated as ground conductors. Though each of these ground conductors is connected to a bridging member, contact elements 1040D and 1040G are not connected to the same bridging member. In embodiments in which contact elements 1040D and 1040G are designated for carrying high speed signals, a bridging member may be included to provide a conductive or partially conductive connection between contact elements 1040D and 1040G. Such a connection may be formed by extending bridging member 1010A and/or bridging member 1010B such that bridging members 1010A and 1010B contact each other. In other embodiments, a bridging member formed of lossy material may span from contact element 1040A to contact element 1040J, though making direct contact only to contact elements designated as ground conductors.

However, it should be appreciated that a bridging member connecting contact elements 1040D and 1040G is not a requirement of the invention. In some embodiments, contact elements 1040E and 1040F may be designated as signal conductors for low frequency signals such that a bridging member making a connection between adjacent ground conductors would not be required to meet the requirements for low frequency signals. Alternatively, bridging members 1010A and 1010B, even though not directly connected, may provide improved performance, even when high frequency signals are carried on contact elements 1040E and 1040F.

In the embodiment illustrated in FIG. 10, bridging members are included only for a row of contact elements that has mating portions along the upper surface of mating cavity 512 (FIG. 5). Such a connector may be useful when contact elements in the upper row of the connector are designated for carrying high frequency signals. Though, bridging members may be used with other rows. A row of contact elements, such as the contact elements in row 560B (FIG. 5) may be inserted through a front face 514 of housing 510. Contact elements in row 560B may be designated to carry low frequency signals for which a bridging member is not necessary to improve performance. Though one or more bridging members may be positioned to connect to ground conductors in row 560B. Such bridging members may be positioned adjacent a front face of the housing 510 or other surface through which those contact elements are inserted.

More generally, in embodiments in which contact elements in more than one row of contact elements are designated to carry high frequency signals, bridging members may be attached to contact elements of a connector adjacent more than one surface. Such a configuration may occur for example in a stacked SFP connector.

Figure 11:
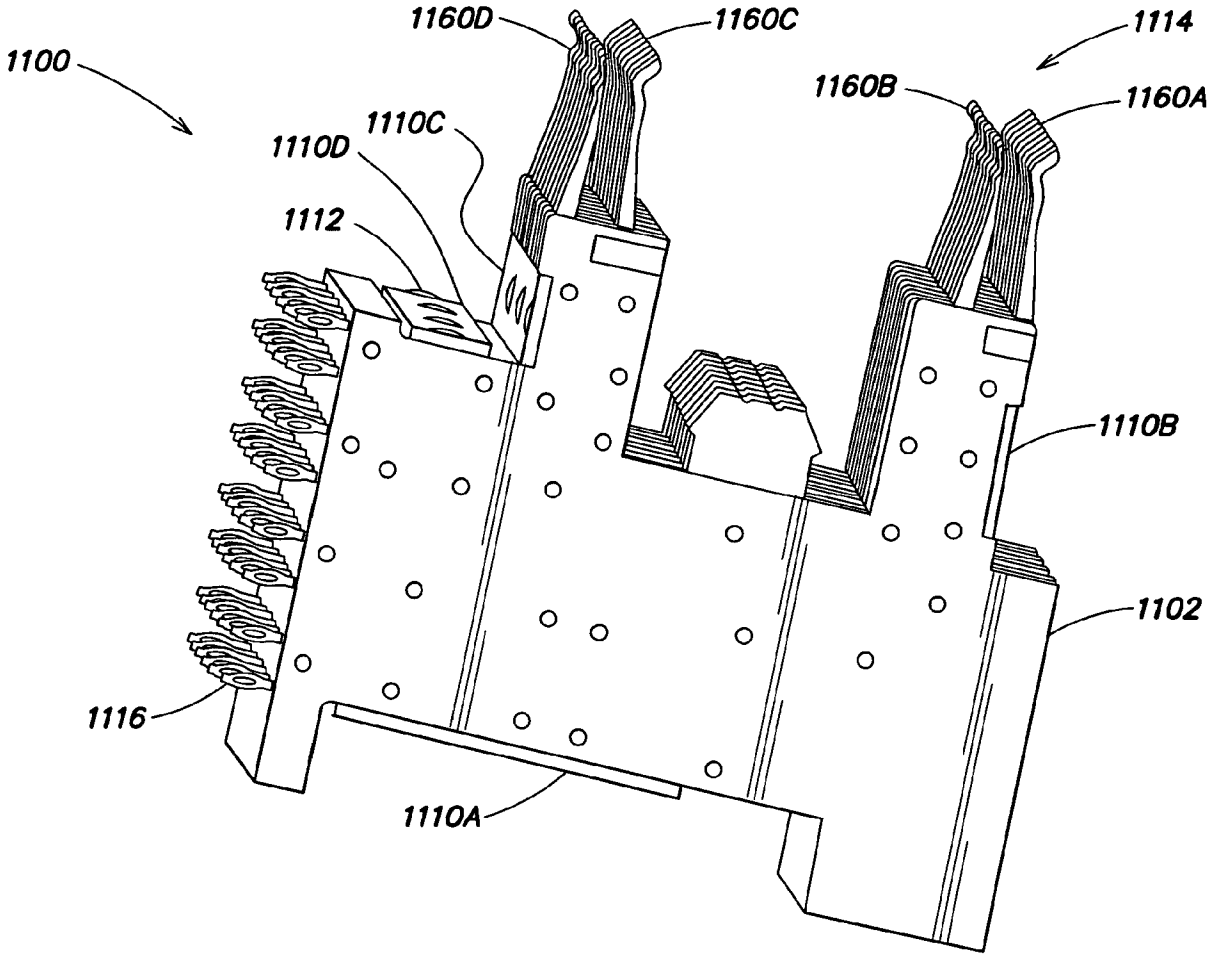
FIG. 11 is a perspective view of a wafer assembly of a stacked SFP connector according to embodiments of the invention.

FIG. 11 is a perspective view of a subassembly of a stacked SFP connector incorporating bridging members according to some embodiments. The stacked SFP connector in this example contains two ports, each with two rows of contact elements. For each port, contact elements designated for carrying high speed signals are located in one of the rows. That row is adjacent an exterior surface of the connector housing, such that a bridging member may be attached to contact elements in the row ground conductors through the adjacent exterior surface.

In the illustrated embodiment, subassembly 1100 may be formed from multiple components, which may be termed "wafers." Each wafer may contain multiple contact elements held by material that acts as a housing. These wafers may be attached to each other, such as through the use of snap-fit components or adhesives. Alternatively, the wafers may be held together in any suitable way, such as through insertion in a shell or attachment to another support structure. Use of wafers provides an alternative to assembling connectors by inserting contact elements into a housing.

In this example, the housing holds the contact elements in four rows, rows 1160A, 1160B, 1160C and 1160D. These four rows include, in the embodiment illustrated, contact portions 1114 positioned in the same way as the mating portions of the contact elements in a standard stacked SFP connector as illustrated in FIGS. 4A and 4B. Likewise, the housing of subassembly 1100 holds contact tails 1116 associated with the contact elements in the same positions as contact tails associated with a stacked SFP connector with a standard form factor as illustrated in FIGS. 4A and 4B. Such spacing enables an improved high frequency SFP connector formed with subassembly 1100 to be interchanged with a standard stacked SFP connector. However, it should be appreciated that the techniques described herein for manufacturing subassembly 1100 are not limited in application to stacked SFP connectors and may be used in connectors of any suitable form factor.

FIG. 11 shows that subassembly 1100 contains multiple bridging members, adjacent multiple surfaces of subassembly 1100. In the embodiment illustrated in FIG. 11, rows 1160A and 1160D contain contact elements designated to carry high speed signals. As shown, bridging members 1110A and 1110B are adjacent surfaces of subassembly 1110 adjacent intermediate portions of contact elements in row 1160A. Bridging members 1110C and 1110D are adjacent surfaces of subassembly 1100 adjacent the contact elements in row 1160D.

The illustrated approach of integrating bridging members uses generally planar sheets of lossy material. Such material may be readily incorporated into a connector housing without materially changing the outside dimensions of the housing. Also, multiple sheets of lossy material may be incorporated to provide multiple bridging members along the length of the intermediate portions of the contact elements. In the example illustrated in FIG. 11 in which the intermediate portions bend through a ninety degree angle, sheets of lossy material attached to intermediate portions of the same row of contact elements may be mounted to surfaces of the housing that are perpendicular to each other. In this way, the bridging members may be connected to the intermediate portions of ground conductors in central regions, such as a region between about 25 and 75 of the distance along the intermediate portion from the contact tail.

In the embodiment of FIG. 11, bridging members 1110A, 1110B, 1110C and 1110D are formed of a lossy material. The lossy material presses against insulative portions of housing 1102. Each of the bridging members 1110A . . . 1110D includes a feature adapted to engage a complimentary feature of multiple contact elements to be connected through the bridging members. In the example illustrated, the contact elements designated as ground conductors contain projections 1112 extending from housing 1102. Projections 1112 engage slots formed through bridging members 1110A . . . 1110D. In the embodiment illustrated, bridging members 1110A . . . 1110D are molded from a thermoplastic material with lossy filler and may be secured to subassembly 1100 through an interference fit with projections 1112. Such an interference fit provides both electrical and mechanical connections between bridging members 1110A . . . 1110D and subassembly 1100. However, any suitable mechanism for attachment of bridging members 1110A . . . 1110D to subassembly 1100 may be used.

Likewise, any suitable mechanism may be used to form an electrical connection between bridging members 1110A . . . 1110D and select contact elements within one or more of the rows 1160A . . . 1160D.

In the embodiment illustrated, the contact elements bend through a ninety degree angle such that the intermediate portion of each contact element has perpendicular segments. One segment extends perpendicularly to a surface of the housing intended for mounting against a printed circuit board. A second segment extends at a right angle from this segment and extends parallel to the board mounting surface. In the embodiment illustrated, there are two planar bridging members for each row, one in a plane perpendicular to the board mounting surface and one in a plane parallel to the board mounting interface. In the specific example, bridging members 1110A and 1110D are perpendicular to the board mounting surface and bridging members 1110B and 1110C are parallel. In some embodiments, different numbers of bridging members per row may be included. Further, it is not necessary that each row contain the same number of bridging members. In a specific embodiment, only bridging member 1110B may be present for row 1160A, but bridging members 1110C and 1110D may be present for row 1130D.

Figure 12A:
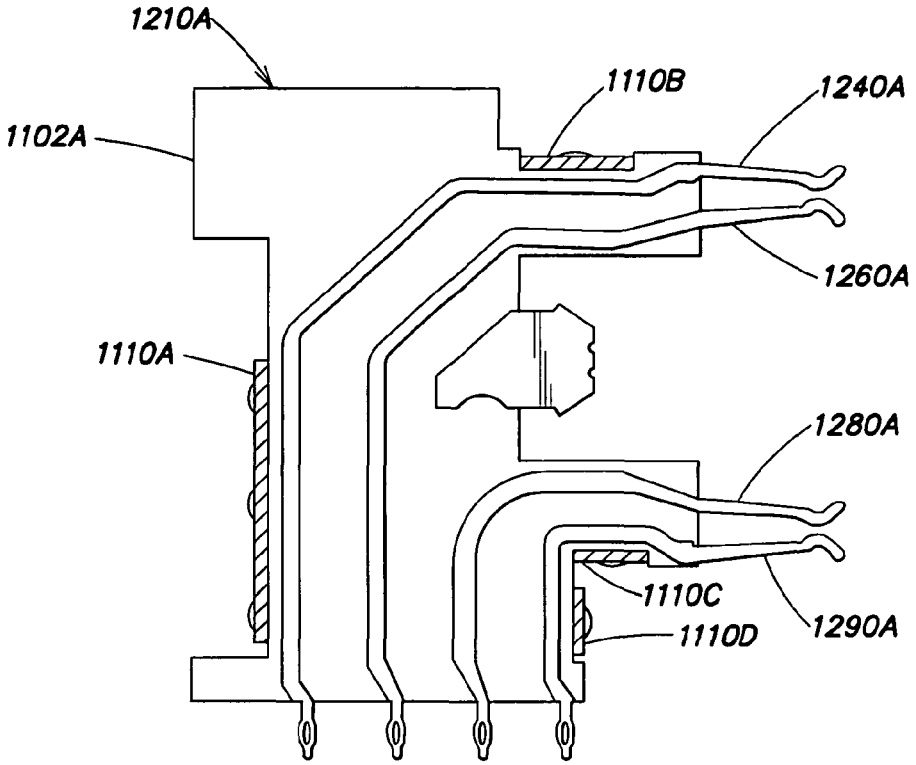
FIGS. 12A and 12B is each a plan view of a wafer used in the SFP wafer assembly of FIG. 11.
Figure 12B:
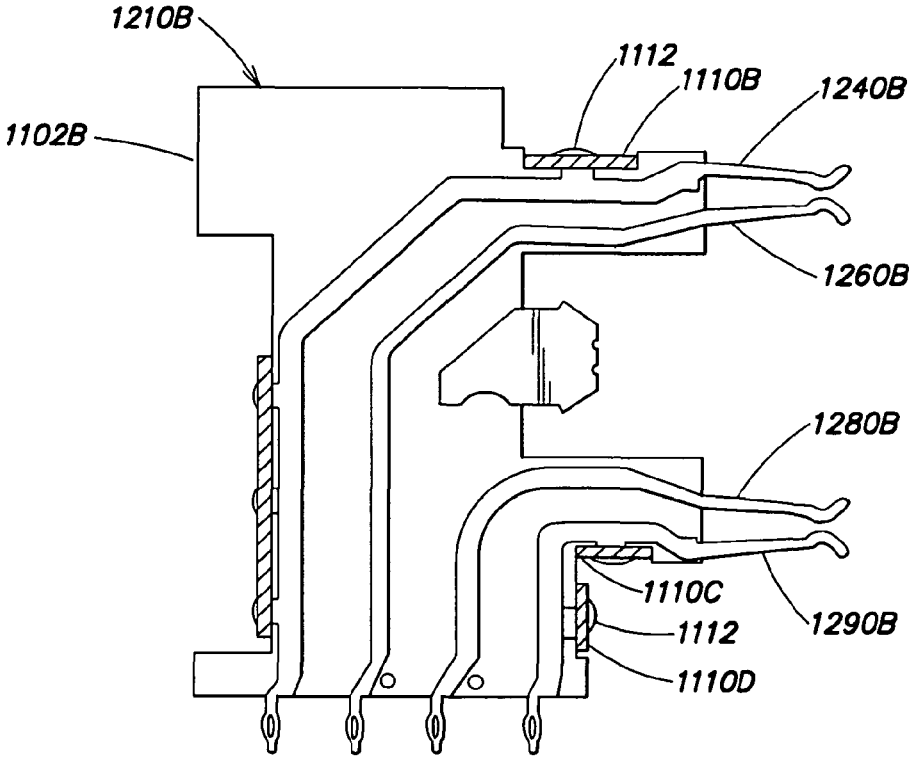

FIGS. 12A and 12B illustrate wafers that may be used in forming subassembly 1100. In the embodiment illustrated, multiple types of wafers may be used in forming subassembly 1100. FIGS. 12A and 12B illustrate two types of, wafers 1210A and 1210B are illustrated. These wafers may be arranged side-by-side, in a repeating pattern to form a subassembly with contact elements in a desired arrangement. FIGS. 12A and 12B show two types of wafers. However, in some embodiments, more than two types of wafers may be used to form a wafer subassembly.

As shown, wafer 1210A contains contact elements 1240A, 1260A, 1280A and 1290A. Wafer 1210B contains contact elements 1240B, 1260B, 1280B and 1290B. The contact elements in wafer 1210A contain an intermediate portion within housing 1102A. Each of the contact elements includes a contact tail extending from a lower face of housing 1102A and adapted for making contact to a conducting structure, such as a via, on a printed circuit board. Each of the contact elements 1240A, 1260A, 1280A and 1290A also contains a contact portion extending from housing 1102A for mating with a paddle card or mating connector in other suitable form.

Contact elements 1240B, 1260B, 1280B and 1290B within wafer 1210B similarly contain intermediate portions within housing 1102B. Contact tails extending from face of housing 1102B and contact portions extending from other surfaces provide contact points for attachment to a printed circuit board or for mating to mating connectors.

The wafers may be made using known over-molding techniques. As one example, the wafers may be formed by molding material around a lead frame that has been stamped from a sheet of metal. The molding material may be insulative material forming an insulative housing. The lead frame may contain contact elements, as illustrated, joined to support structures. At some point after a housing has been overmolded, those support structures may be cut away, leaving the wafers as illustrated. Though, wafers may be made in any suitable way.

In the embodiments illustrated in FIGS. 12A and 12B, the contact elements contain contact portions and contact tails positioned and shaped to conform with the form factor of a standard SFP connector. However, intermediate portions of some or all of the contact elements may be shaped to provide improved high frequency performance for contact elements designated as high speed signal conductors. In the embodiment illustrated, contact elements 1240A and 1290A are designated as high frequency signal conductors. Contact elements 1260A and 1280A are designated as standard or low frequency signal conductors. Contact elements 1240B and 1290B are designated as ground conductors.

When a subassembly 1100 is formed from wafers of the types illustrated in FIGS. 12A and 12B, wafers of type 1210B are interspersed in a pattern with wafers of type 1210A. One such pattern may include a wafer of type 1210B followed by two wafers of type 1210A. As a result, contact elements designated as high frequency signal conductors, such as contact elements 1240A and 1290A, will be positioned adjacent contact elements designated as ground conductors, such as contact elements 1240B and 1290B. By appropriate arrangement of wafers of the different types, pairs of contact elements designated as high speed signals conductors will be positioned in rows between contact elements designated as ground conductors.

In the embodiment illustrated in FIGS. 12A and 12B, one or more of the contact elements may be shaped for improved high frequency performance. As one example of such shaping, the contact elements is that contact elements designated as ground conductors include features for making connection to bridging members. In the example of FIG. 12B, contact elements 1240B and 1290B contain projections 1112. Projections 1112 engage complimentary features on bridging members 1110A . . . 1110D. In contrast, as can be seen in FIG. 12A, contact elements designated as signal conductors are isolated from the bridging members 1110A . . . 1110D by portions of insulative housing 1102A.

As a further example of such shaping, contact elements 1240A and 1290A, which are designated as high speed signal conductors, have intermediate portions that are narrower than contact elements 1260A and 1280A, which are designated as low speed signal conductors. In contrast, intermediate portions of contact elements 1240B and 1290B, which are designated as ground conductors in a row containing high speed signal conductors, are wider than the intermediate portions of contact elements 1260B and 1280B, which may either be designated as low speed signal conductors or grounds within a row for low speed signal conductors. As described in conjunction with FIGS. 15A and 15B below, such dimensions may be selected to provide a desired differential mode and common mode impedance for differential pairs of which contact elements 1240A and 1290A each may form one leg. As an example, these dimensions may provide a desired differential mode impedance of approximately 100 ohms or 85 ohms and a common mode impedance in the range of 20 to 40 Ohms, such as, for example, approximately 32 ohms. In contrast, contact elements 1260A, 1280A, 1260B and 1280B may have impedance characteristics comparable to standard SFP connectors or any other suitable value.

A further feature that may be incorporated into contact elements of the type illustrated in FIG. 12A is that contact elements designated for carrying high speed signal conductors have intermediate portions positioned to be spaced by a relatively small distance from adjacent ground conductors. This spacing may be selected to provide desired impedances. Such spacing may be achieved by constructing wafers in which the intermediate portions of the contact elements designated as high speed signal conductors are offset relative to a plane containing the tail and mating portion of the contact elements. In contrast to some differential connectors in which intermediate portions of signal conductors forming a differential pair jog towards each other, the intermediate portions jog away from each other.

This offset positions the intermediate portions of contact elements 1240A and 1290A, designated as high speed signal conductors, in closer proximity to intermediate portions of contact elements designated as ground conductors than if contact elements 1240A and 1290A did not bend out of that plane. This shaping further alters the common mode impedance of the differential pairs formed by a adjacent contact elements shaped for carrying high speed signals. The spacing between the signal conductors and adjacent ground conductors may be selected to provide a desired common mode impedance in the range of 20-40 Ohms, or other desired value.

Multiple wafers of the types illustrated in FIGS. 12A and 12B may be aligned side-by-side to form a wafer subassembly as illustrated in FIG. 11. Though, in embodiments in which the signal conductors jog away from each other, more than two types of wafers may be used. For example, a group of four adjacent conductive elements along a row, two signal conductors forming a high speed pair and two grounds, may be provided by four types of wafers. For low speed signal conductors, yet a further type of wafer may be used. Multiple wafers of these types may be organized in a row to make any desired pattern. In such an embodiment, a total of five types of wafers may be used to construct a wafer subassembly. However, any suitable number of types of wafers may be used.

Regardless of the number of types of wafers, the wafers may be held together in any suitable way, including through the use of adhesives, pins, rivets or other connecting features. Bridging members, such as bridging members 1110A, 1110B, 1110C and 1110D may then be attached to the wafer subassembly. The wafer subassembly may then be inserted into an outer housing. Though, in some embodiments, the wafers may be held together within the outer housing without any separate mechanism to hold them together before they are inserted into the outer housing.

Figure 13:
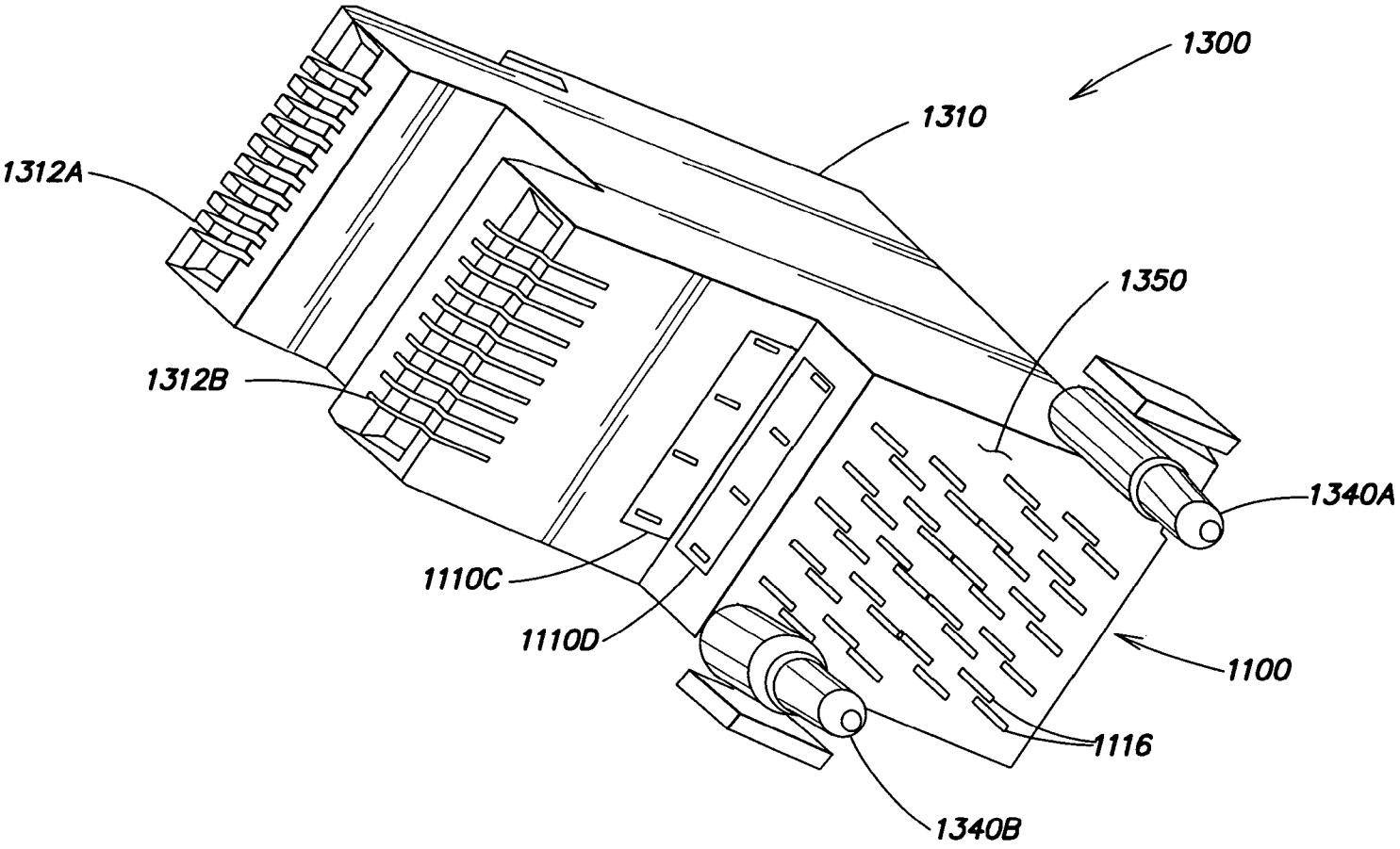
FIG. 13 is a perspective view of a stacked SFP connector incorporating the wafer assembly of FIG. 11 with a bottom of the connector visible.

In embodiments in which the connector is to have a form factor matching a stacked SFP connector, the outer housing may be shaped to provide two mating cavities, positioned as indicated in FIG. 4A. FIG. 13 illustrates a connector 1300 formed in this fashion. Outer housing 1310 encloses wafer subassembly 1100. Outer housing 1310 includes mating cavities 1312A and 1312B that enclose the mating portions of the contact elements in rows 1160A . . . 1160D. As can be seen in FIG. 13, outer housing 1310 includes slots along upper and lower surfaces of mating cavities 1312A and 1312B. Though not visibly in FIG. 13, mating portions 1114 (FIG. 11) of the contact elements within the connector fit within these slots such that they may exhibit compliant motion when a cable connector is inserted into mating slot 1312A or 1312B.

FIG. 13 shows stacked SFP connector 1300 from a perspective that reveals lower surface 1350 of connector 1300. Lower surface 1350 is configured to be mounted adjacent a surface of a printed circuit board containing a footprint according to the SFP standard for a stacked SFP connector. Lower surface 1350 includes board attachment features 1340A and 1340B and contact tails 1116, all of which may be positioned in accordance with the SFP standard. Mating cavities 1312A and 1312B may also be positioned according to the standard. As a result, connector 1300 may be used in an electronic device in place of a standard SFP connector. When used in this fashion, connector 1300 incorporating some or all of the improvements described above, will provide improved performance relative to a standard SFP connector. As can be seen in FIG. 13, connector 1300 includes bridging members, such as bridging members 1110C and 1110D. Here, bridging members 1110C and 1110D are recessed into the outer housing 1310. Thus, even though such bridging members are not part of a standard SFP connector, they do not change the form factor of the connector. Such a configuration, in which bridging members are attached to exterior surfaces of an outer housing may be desirable because it allows the same components to be used to assemble multiple versions of the connector, some with higher performance than others. Though, in scenarios in which a single versions is desired, bridging members could alternatively be integrated into the outer housing and/or the wafer housings. Bridging members could be integrated, for example, by a two-shot molding process in which housing components are in a multi-step operation, including a step in which insulative portions of the housing are molded and a separate step in which lossy portions of the housing are molded.

Improvements relating to the shape and positioning of contact elements may also be included, but are not visible in FIG. 13 because they are internal to outer housing 1310 and do not impact connector performance.

Figure 14:
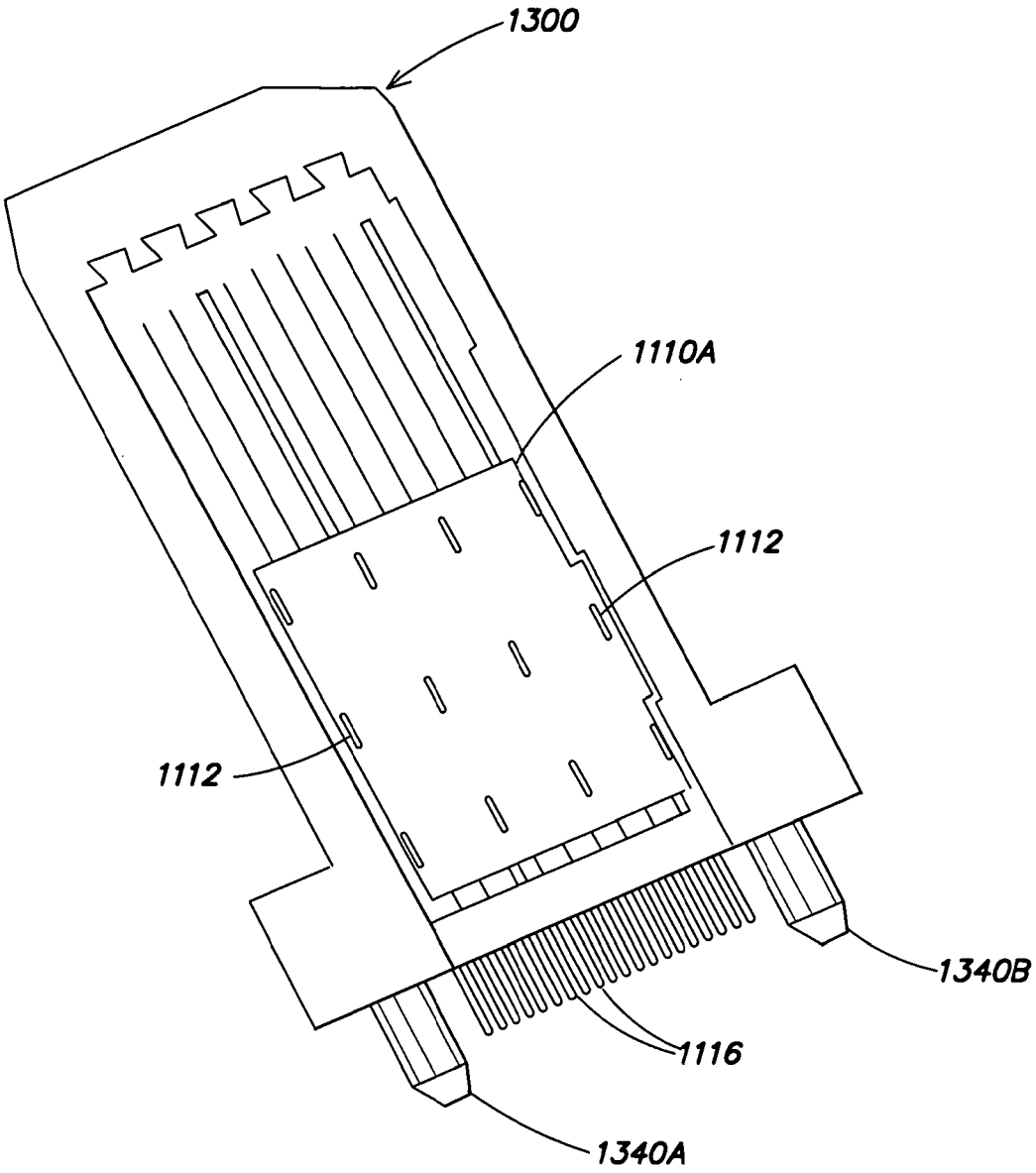
FIG. 14 is a perspective view of the stacked SFP connector of FIG. 13 with the back of the connector visible.

FIG. 14 shows connector 1300 from a different perspective, here illustrating the rear surface of connector 1300. In this perspective, bridging member 1110A is visible. As can be seen, projections 1112 extending from contact elements designated as ground conductors within connector 1300 are also visible. Projections 1112 make electrical connection between bridging member 1110A and the ground conductors as well as provide mechanical attachment for bridging member 1110A.

Figure 15A:
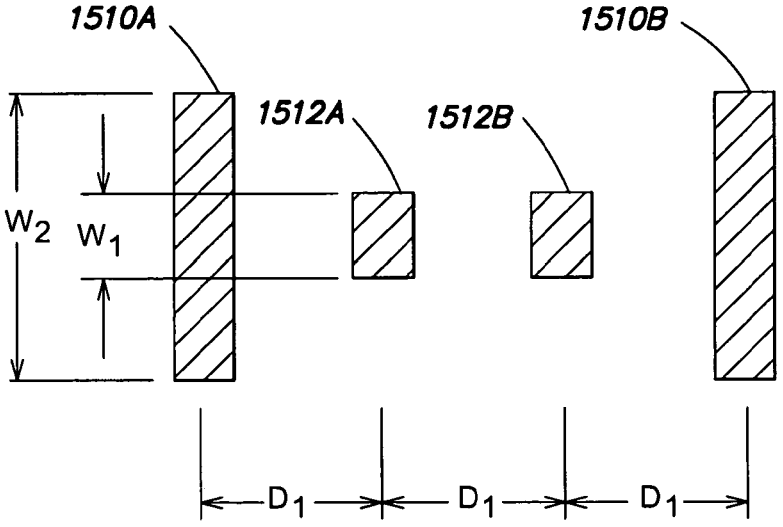
FIG. 15A is a sketch illustrating a cross section through a pair of signal contact elements and adjacent ground contact elements in the stacked SFP connector of FIG. 13, according to some embodiments.

Within connector 1300, the contact elements may be shaped to provide improved electrical characteristics using some or all of the techniques described above. FIG. 15A illustrates a cross-section through a portion of connector 1300 according to some embodiments. FIG. 15A illustrates a cross-section through the intermediate portions of four adjacent contact elements in a row designated to carry high speed signals. Contact elements 1510A, 1510B, 1512A and 1512B are illustrated. Contact elements 1510A and 1510B may be contact elements designated to act as ground conductors. Contact elements 1512A and 1512B may be contact elements designated to carry high frequency signals. In this example, the intermediate portions of all the contact elements are spaced on a uniform pitch, designated $D_1$. Such a spacing may correspond to the pitch between contact tails and mating portions of the contact elements. As an example, the spacing $D_1$ may be on the order of 0.5 mm to about 2 mm. As a specific example, the spacing $D_1$ may be 0.8 mm.

Contact elements 1510A and 1510B are here shown to have a width, $W_2$, such that the intermediate portions of each contact element is in the same plane as the contact tails and mating portion. In contrast, contact elements 1512A and 1512B are shown to have a width, $W_1$, which is less than $W_2$. The respective widths $W_1$ and $W_2$ may be selected to provide a desired common mode impedance when contact elements 512A and 512B are connected to a circuit assembly to carry high speed signals through connector 1300.

Figure 15B:
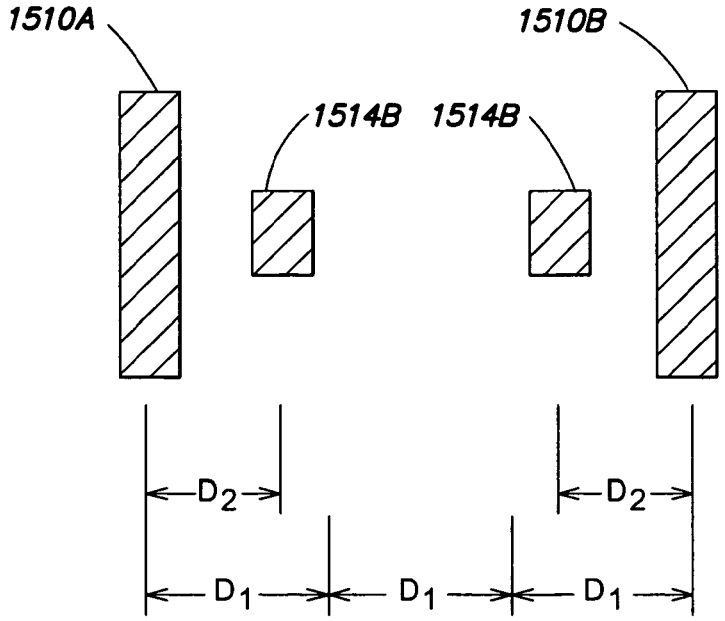
FIG. 15B is a sketch through a pair of signal contact elements and adjacent ground contact elements of the SFP connector of FIG. 13, according to some alternative embodiments.

FIG. 15B shows an alternative embodiment. In the embodiment of FIG. 15B, though the contact elements have an average spacing of distance $D_1$, the intermediate portions of the contact elements 1514A and 1514B are each spaced from an adjacent ground contact element, 1510A and 1510B, respectively, by a smaller amount. As shown, contact element 1514A is spaced from contact element 1510A by a distance $D_2$. Contact element 1514B is likewise spaced from contact element 1510B by a distance $D_2$. As can be seen, distance $D_2$ is less than distance $D_1$. In some embodiments, distance $D_2$ may be between about 0.2 mm and 0.6 mm. As a specific example, when distance $D_1$ is 0.8 mm, distance $D_2$ may be 0.4 mm.

In embodiments in which the contact tails and mating portions of the contact elements within the connector are to be on a pitch of $D_1$, such as may be specified by a connector standard, the spacing between intermediate portions illustrated in FIG. 15B may be achieved by bending the intermediate portions of contact elements 1514A and 1514B towards the adjacent contact elements, 1510A and 1510B, respectively. Though, similar spacing may be achieved by bending contact elements 1510A and 1510B towards contact elements 1514A and 1514B.

Figure 15C:
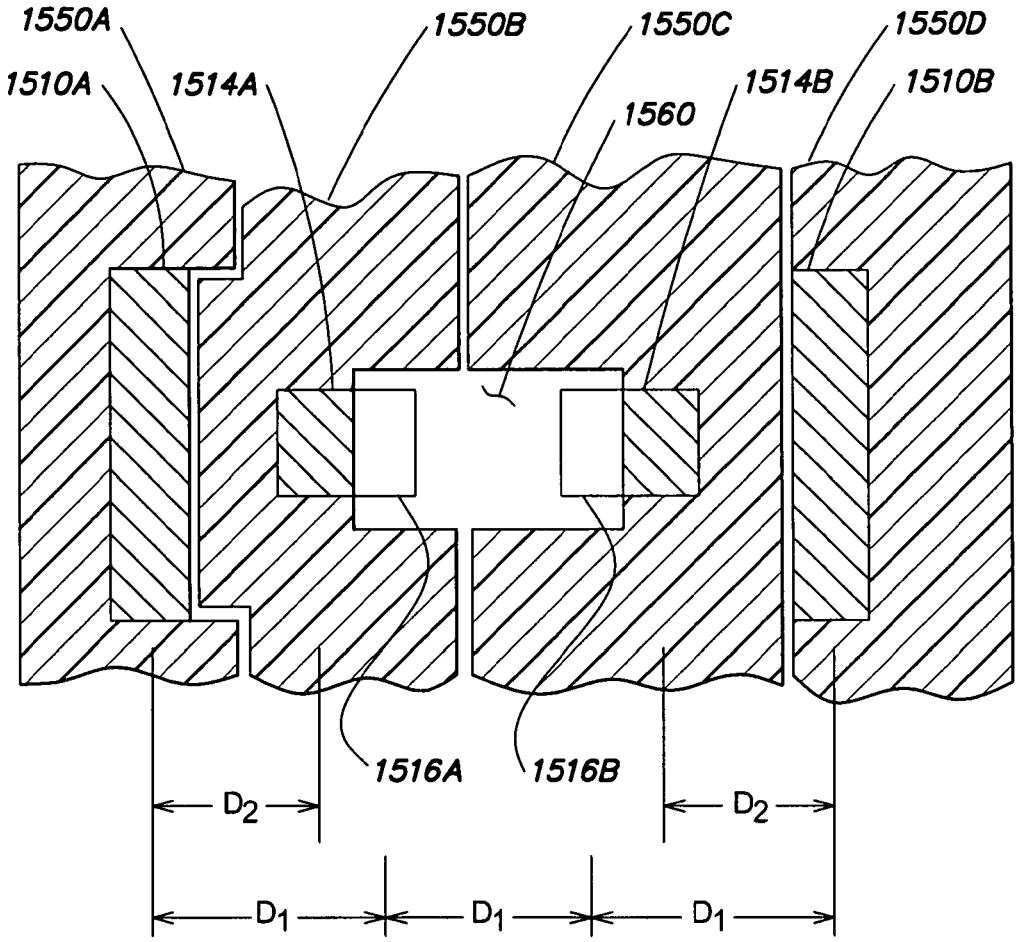
FIG. 15C is a sketch through a pair of signal contact elements and adjacent ground contact elements of the SFP connector of FIG. 13, showing housing portions of wafers, according to some alternative embodiments.

FIG. 15C illustrates wafer housings such that, when the wafers are stacked side by side, the configuration of FIG. 15B results. A shown in FIG. 15C, contact elements 1510A and 1510B are included as a portion of wafers with housing portions 1550A and 1550D, respectively. Contact elements 1514A and 1514B are included as a portion of wafers with housing portions 1550B and 1550C, respectively.

In the cross section illustrated in FIG. 15C, it can be seen that the intermediate portions of signal conductors are offset relative to the contact tails. As shown, the intermediate portion of conductive element 1514A is offset relative to the plane containing contact tail 1516A, for that conductive element. Likewise, the intermediate portion of conductive element 1514B is offset relative to the plane containing contact tail 1516B, for that conductive element.

As illustrated, the housing portions of the wafers need not be of the same width as each other or of uniform width throughout. Differences from wafer to wafer may exist to accommodate the jogged positioning of the intermediate portions of the signal conductors. For example, housing portion 1550B projects outwards towards housing portion 1550A to allow contact element 1514A to be closely spaced to contact element 1510A. However, a similar projection need not be included in housing 1550C to achieve the same spacing relative to housing portion 1550D. Though, wafer housings of any suitable shape may be used to provided suitable positioning of contact elements.

FIG. 15C also illustrates features that may be incorporated into the connector housing for improved electrical performance. Slots may be molded in wafer housings 1550B and 1550C adjacent conductive elements intended to be high speed signal conductors. Those slots may be molded such that when the wafers carrying the signal conductors are positioned side-by-side, the slots align to form an elongated cavity 1560 between a signal conductors designated as a differential pair for high speed signals. Cavity 1560, positioned between signal conductors in a pair may improve performance be decreasing signal loss. Additionally, having a cavity 1560 filled with air may decrease the propagation time through the connector. For stacked SFP connectors, the contact elements may be physically long enough to introduce an undesirable propagation delay. This delay may be lessened through the use of cavity 1560.

FIG. 15C illustrates a portion of the conductive elements in one row of a connector. Similar construction techniques may be used for each pair of signal conductors designated as a high speed signal pair in the row. Similar techniques may also be used for conductive elements designated as low speed signal conductors, but in some embodiments, no cavity comparable to cavity 1560 will be included between adjacent low speed signal conductors.

Similar construction techniques may be used in all rows of the connector having conductive elements designated to carry high speed signals, but in some embodiments different rows will have different configurations. The portion illustrated may correspond to a portion of row 1160A (FIG. 11). For a two port stacked SFP connector, this is the longest row of the connector and the longer of the two rows carrying high speed signals. In some embodiments, a cavity 1560 may be included between high speed signal conductors in both rows. Though, in other embodiments, cavities, such as cavity 1560 may be included only in connection with the longer row. Such cavities, for example, may be used to equalize delay between pairs in the longer row, such as row 1160A, and the shorter row, such as row 1160D.

Other variations are possible. In the embodiment illustrated, cavity 1560 is filled with air. Performance improvements may also be filled by forming slots filled with material other than air. A material with a dielectric constant that is lower than the dielectric constant of wafer housings 1550B and 1550C may be used. As a specific example, wafer housings 1550B and 1550C may be molded of a material having a relative dielectric constant on the order of 3.2. Cavity 1560 may be filled with a material or materials that have an average relative dielectric constant between about 1 and 2.5.

Figure 16:
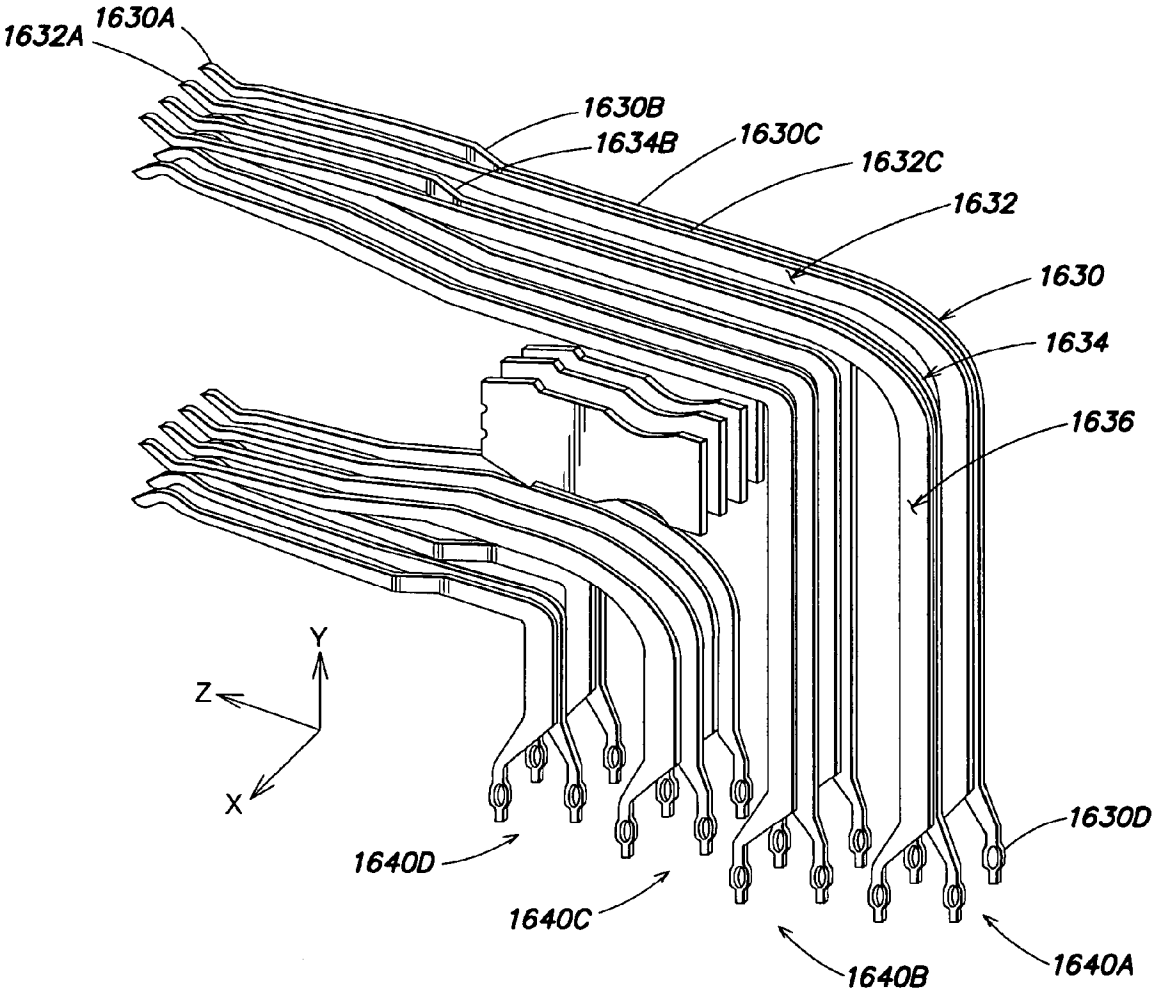
FIG. 16 is a perspective view of contact elements in a stacked SFP connector employing the spacing illustrated in FIG. 15B.

FIG. 16 is a perspective view of an alternative embodiment in which some of the techniques for improved high frequency performance described above are employed. FIG. 16 illustrates a subset of the contact elements in a connector with the connector housing cut away to reveal the structure and positioning of the contact elements. FIG. 16 illustrates an embodiment in which intermediate portions of some of the contact elements are offset to reduce the spacing relative to an adjacent contact element. Within row 1640A, the intermediate portion 1630C of contact element 1630 is offset relative to mating portion 1630A entail 1630D. As a result, the center-to-center spacing between intermediate portions 1630C and 1632C of contact elements 1630 and 1632 is smaller than the center-to-center spacing between mating portions 1630A and 1632 of those contact elements. This difference in spacing is achieved through a transition region 1630B in which contact element 1630 bends out of the plain containing mating portion 1630 and tail 1630D.

A similar transition region 1634B is included in contact element 1634. In this configuration, contact elements 1630 and 1634 may be designated as signal conductors. Contact elements 1630 and 1636 may, in some embodiments, be designated as ground conductors. Contact elements 1632 and 1634 may be designated to carry signals. As shown, the signal to ground spacing is decreased as a way to provide a desired common mode impedance, with only two types of wafers. Though, in the embodiment illustrated, contact elements 1632 and 1636 have the same width as contact elements 1630 and 1634. Though, because the contact elements are generally of the same width, the designations of signal and ground conductors may be changed in some embodiments.

In the configuration illustrated in FIG. 16, row 1640D similarly contains contact elements with an offset. Accordingly, some of the contact elements in row 1640D may be designated as high speed signal contacts. In contrast, rows 1640B and 1640C contain contact elements without transition regions corresponding to transition regions 1630B and 1634B. Contact elements in rows 1640B and 1640C may be designated to carry low speed signals and reference potentials, such as power and ground.

Figure 17:
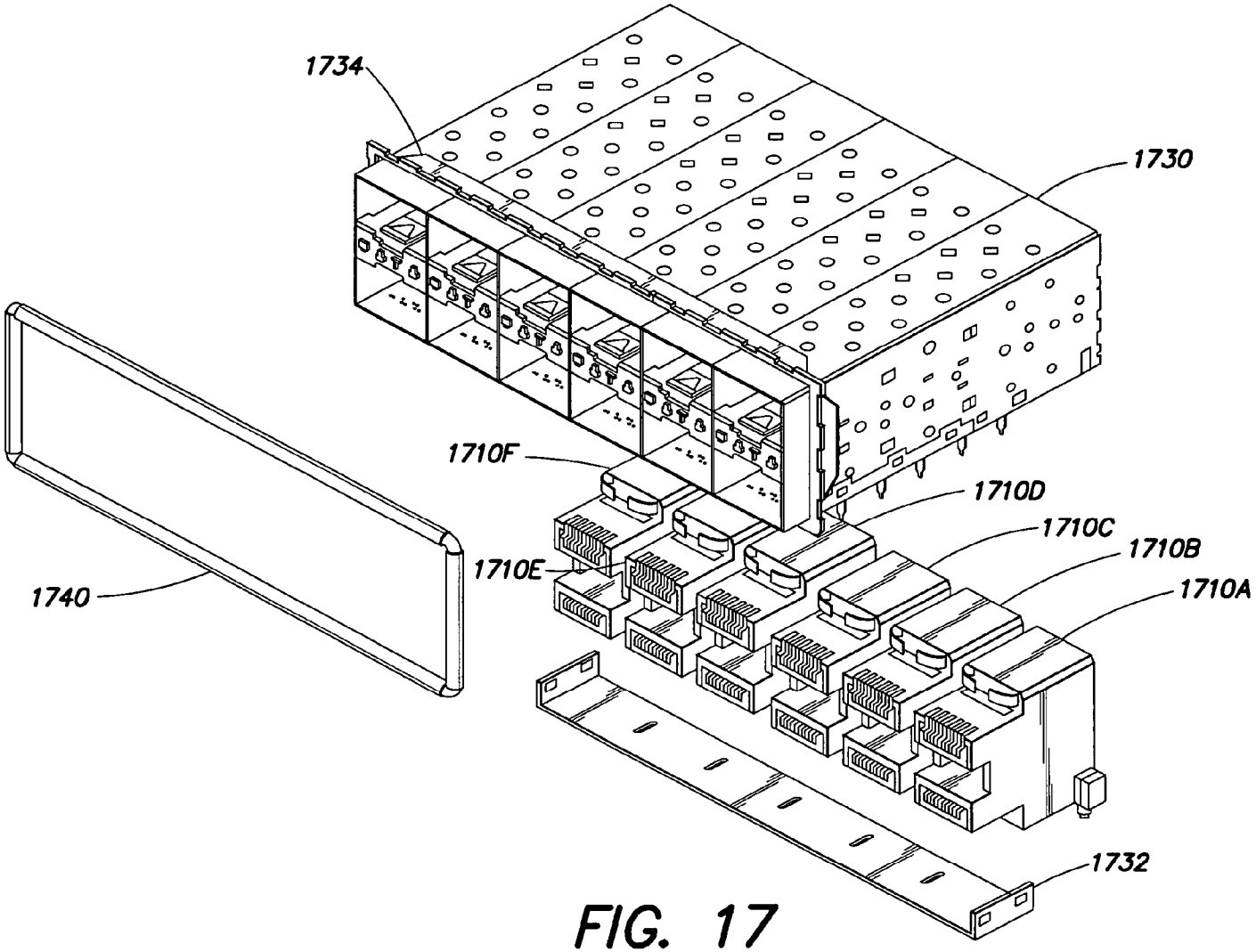
FIG. 17 is an exploded view of multiple SFP connectors as in FIG. 13 positioned for use in connecting multiple cables to an electronic device.

FIG. 17 illustrates a portion of an electronic device in which connectors, such as connector 1300 (FIG. 13), incorporating some or all of the improvements described above may be incorporated. FIG. 17 is an exploded view of components of an interconnection system. In the embodiment illustrated in FIG. 17, that interconnection system is configured to receive up to ten cable connectors. Here, five connectors, 1710A . . . 1710F, each having a stacked SFP form factor are used. Each of the connectors 1710A . . . 1710F may be in the form of connector 1300 (FIG. 13). Each of the connectors 1710A . . . 1710F, though incorporating one or move of the improvements described above, may be used in an assembly like a standard stacked SFP connector.

Though not illustrated in FIG. 17, each of the connectors 1710A . . . 1710F may be attached to a printed circuit board (not shown). A cage 1730 may then be placed over connectors 1710A . . . 1710F and also mounted to the printed circuit board. A floor member 1732 may be placed between the cage 1730 and printed circuit board (not shown) to seal an opening in the bottom of cage 1730 through which connectors 1710A . . . 1710F are inserted. Gasket 1740 may be installed around openings into cage 1730. Gasket 1740 may be positioned adjacent flange 1734.

The circuit board containing connector 1710A . . . 1710F may then be inserted into an electronic device. The support structure for the electronic device may hold the printed circuit board (not shown) such that cage 1730 is adjacent an opening in a panel of the electronic device. The board may be inserted until gasket 1740 is pressed between the panel and flange 1734, creating a seal around the panel opening. In this way, stacked SFP connectors incorporating improvements described above may be used in place of standard stacked SFP connectors. However, as described above, at least some of the contact elements in those connectors will receive and reliably propagate high speed signals. Though it is known to use a cage and gasket to reduce EMI radiation from an interconnection system, particularly one operated at high frequency, further advantage in EMI performance of the interconnection system may be achieved using techniques as described above. For example, use of bridging members may reduce resonances that can lead to increase EMI radiation. Because governmental regulations limit EMI from an electronic device, use of bridging members and other techniques as described above may allow a system to meet EMI limits while operating at higher frequencies than such systems could if constructed with standard connectors.

Having thus described several aspects of at least one embodiment of this invention, it is to be appreciated various alterations, modifications, and improvements will readily occur to those skilled in the art.

For example, the techniques described herein need not all be used together. These techniques may be used in any suitable combination to provide desired connector performance.

As another example of possible variations, although inventive aspects are shown and described with reference to an SFP connector, it should be appreciated that the present invention is not limited in this regard, as the inventive concepts may be included in connectors manufactured according to other standards or even connectors that are not manufactured according to any standard.

As a specific example, though embodiments describe contact elements having contact tails extending from a lower face of a connector and a cavity, shaped to receive a mating connector, in a front face that is at a right angle relative to the lower face, this orientation is not required. The front face, for example, could be parallel to the lower face.

Also, though embodiments of connectors assembled from wafers are described above, in other embodiments connectors may be assembled from wafers without first forming wafers. As an example of another variation, connectors may be assembled without using separable wafers by inserting multiple columns of conductive members into a housing.

Additionally, though lossy material is described as being used to form separable bridging members, it is not necessary that the bridging members be separable from the housing. The lossy material may be selectively placed within the insulative portions of the housings, such as through a multi-shot molding procedure.

In the embodiments illustrated, some conductive elements are designated as forming a differential pair of conductors and some conductive elements are designated as ground conductors. These designations refer to the intended use of the conductive elements in an interconnection system as they would be understood by one of skill in the art. For example, though other uses of the conductive elements may be possible, differential pairs may be identified based on preferential coupling between the conductive elements that make up the pair. Electrical characteristics of the pair, such as its impedance, that make it suitable for carrying a differential signal may provide an alternative or additional method of identifying a differential pair. For example, a pair of signal conductors may have a differential mode impedance of between 75 Ohms and 100 Ohms. As a specific example, a signal pair may have an impedance of 85 Ohms+/−10%. As yet another example, a connector in which a row containing pairs of high speed signal conductors and adjacent ground conductors was described. It is not a requirement that every signal conductor in a row be part of a pair or that every signal conductor be a high speed signal conductor. In some embodiments, rows may contain lower speed signal conductors intermixed with high speed signal conductors.

As another example, certain features of connectors were described relative to a "front" face. In a right angle connector, the front face may be regarded as surfaces of the connector facing in the direction from which a mating connector is inserted. However, it should be recognized that terms such as "front" and "rear" are intended to differentiate surfaces from one another and may have different meanings in electronic assemblies in different forms. Likewise, terms such as "upper" and "lower" are intended to differentiate features based on their relative position to a printed circuit board or to portions of a connector adapted for attachment to a printed circuit board. Such terms as "upper" and "lower" do not imply an absolute orientation relative to an inertial reference system or other fixed frame of reference.

Accordingly, the invention should be limited only by the attached claims.

What is claimed is:

1. An electrical connector, comprising:

a housing comprising:

a front face;

a rear face;

a cavity with an opening in the front face shaped to receive a mating connector; and a plurality of slots in the rear face, each of the plurality of slots opening into the cavity;

a plurality of conductive contact elements, each contact element comprising:

a contact tail, a mating portion and an intermediate portion connecting the contact tail and the mating portion, each of the plurality of contact elements being positioned within the housing with the intermediate portion disposed within a slot of the plurality of slots and the mating portion projecting into the cavity;

a bridging member disposed external to the housing, the bridging member being fully or partially conductive and having a first portion contacting the intermediate portion of a first contact element of the plurality of contact elements and a second portion contacting the intermediate portion of a second contact element of the plurality of contact elements, the first contact element and the second contact element being separated by at least one other contact element of the plurality of contact elements, the at least one other contact element not contacting the bridging member.

2. The electrical connector of claim 1, wherein the bridging member comprises metal.

3. The electrical connector of claim 1, wherein the bridging member comprises an insulative binder filled with conductive particles.

4. The electrical connector of claim 1, wherein the at least one other contact element comprises two contact elements.

5. The electrical connector of claim 4, wherein the two contact elements are shaped and positioned as a differential pair of signal conductors.

6. The electrical connector of claim 5, wherein the first contact element and the second contact element comprise ground conductors.

7. The electrical connector of claim 1, wherein the intermediate portion of each of the at least one other contact elements has a first segment extending in a first direction and a second segment, extending in a second direction, perpendicular to the first direction, the first segment extending from the contact tail to the second segment and having a smooth profile.

8. The electrical connector of claim 7, wherein, for each of the at least one other contact elements:

the second segment comprises a barb engaging the housing;

the first segment comprises a curved section;

the housing has a curved surface conforming to the shape of the curved section; and the contact element is positioned with the curved section disposed adjacent the curved surface.

9. The electrical connector of claim 1, wherein the plurality of conductive contact elements comprises a first plurality of conductive contact elements and the bridging member comprises a first bridging member; and the electrical connector further comprises a second plurality of conductive contact elements and a second bridging member contacting a first and second of the second plurality of conductive contact elements without contacting a third conductive contact element disposed between the first and second of the second plurality of conductive contact members.

10. An electronic assembly, comprising:

a printed circuit board;

an electrical connector mounted to the printed circuit board, the electrical connector comprising:

a housing comprising:

a lower surface;

a front face and a rear face; and a cavity with an opening in the front face shaped to receive a mating connector, the connector being mounted to the printed circuit board with the lower surface of the housing adjacent the printed circuit board and the front face and the rear face extending perpendicular to the printed circuit board, a plurality of conductive contact elements, each contact element comprising:

a contact tail connected to the printed circuit board;

a mating portion; and an intermediate portion connecting the contact tail and the mating portion, each of the plurality of contact elements being positioned within the housing with the contact tail adjacent the lower surface and the mating portion projecting into the cavity;

a bridging member disposed external to the housing, the bridging member being fully or partially conductive and having a first portion contacting the intermediate portion of a first contact element of the plurality of contact elements and a second portion contacting the intermediate portion of a second contact element of the plurality of contact elements, the first contact element and the second contact element being separated by at least one other contact element of the plurality of contact elements, the at least one other contact element not contacting the bridging member.

11. The electrical connector of claim 10, wherein the bridging member is formed from a binder filled with conductive particles.

12. An electronic assembly, comprising:

a printed circuit board;

an electrical connector mounted to the printed circuit board, the electrical connector comprising:

a housing comprising:

a lower surface;

a front face and a rear face; and a cavity with an opening in the front face shaped to receive a mating connector, the connector being mounted to the printed circuit board with the lower surface of the housing adjacent the printed circuit board and the front face and the rear face extending perpendicular to the printed circuit board, a plurality of conductive contact elements, each contact element comprising:

a contact tail connected to the printed circuit board;
a mating portion; and
an intermediate portion connecting the contact tail and the mating portion, each of the plurality of contact elements being positioned within the housing with the contact tail adjacent the lower surface and the mating portion projecting into the cavity;

a bridging member disposed adjacent the rear face, the bridging member comprising a lossy material and having a first portion contacting the intermediate portion of a first contact element of the plurality of contact elements and a second portion contacting the intermediate portion of a second contact element of the plurality of contact elements, the first contact element and the second contact element being separated by at least one other contact element of the plurality of contact elements, the at least one other contact element not contacting the bridging member, wherein:

the bridging member comprises a planar member;

the intermediate portion of each of the first contact element and the second contact element comprises a plurality of tabs; and the bridging member is connected to the plurality of tabs of each of the first and second contact elements.

13. An electronic assembly, comprising:

a printed circuit board;

an electrical connector mounted to the printed circuit board, the electrical connector comprising:

a housing comprising:
a lower surface;
a front face and a rear face; and
a cavity with an opening in the front face shaped to receive a mating connector, the connector being mounted to the printed circuit board with the lower surface of the housing adjacent the printed circuit board and the front face and the rear face extending perpendicular to the printed circuit board, a plurality of conductive contact elements, each contact element comprising:
a contact tail connected to the printed circuit board;
a mating portion; and
an intermediate portion connecting the contact tail and the mating portion, each of the plurality of contact elements being positioned within the housing with the contact tail adjacent the lower surface and the mating portion projecting into the cavity;

a bridging member disposed adjacent the rear face, the bridging member comprising a lossy material and having a first portion contacting the intermediate portion of a first contact element of the plurality of contact elements and a second portion contacting the intermediate portion of a second contact element of the plurality of contact elements, the first contact element and the second contact element being separated by at least one other contact element of the plurality of contact elements, the at least one other contact element not contacting the bridging member, wherein:

the first contact element and the second contact element each have first elongated portion extending in a first direction and a second elongated portion extending in a second direction, perpendicular to the first direction;

the bridging member is a first bridging member and is connected to the first portion of each of the first contact element and second contact element; and the electrical connector further comprises a second bridging member connected to the second portion of each of the first contact element and second contact element.

14. The electrical connector of claim 10, wherein:

the housing comprises a shell and a plurality of insulative members, each of the plurality of insulative members having conductive contact elements of the plurality of conductive contact elements embedded therein.

15. An electrical connector adapted for mounting to a planar substrate, the electrical connector comprising:

a housing having a cavity therein, the cavity being bounded by a lower surface and an upper surface, the lower surface being disposed to be closer to the substrate than the upper surface when the electrical connector is mounted to the substrate;

a first plurality of conductive contact elements, each of the first plurality of conductive contact elements comprising:
a contact tail adapted for attachment to the planar substrate;
a mating portion extending through the lower surface of the cavity; and
an intermediate portion connecting the contact tail and the mating portion; and a second plurality of conductive contact elements, each of the second plurality of conductive contact elements comprising:
a contact tail adapted for attachment to the planar substrate;
a mating portion extending through the upper surface of the cavity; and
an intermediate portion connecting the contact tail and the mating portion, the intermediate portion comprising:
a first segment connected to the contact tail and extending perpendicularly to the planar substrate and
a second segment connected to the mating portion extending parallel to the planar substrate; and a bridging member interconnecting multiple ones of the second plurality of conductive contact elements, the bridging member being formed of a lossy conductor and connected to the intermediate portion of each of the interconnected ones of the second plurality of contact elements.

16. The electrical connector of claim 15, wherein the bridging member is coupled to the intermediate portion of each of the interconnected ones of the second plurality of contact elements at a central region of the contact element, the central region being 25 to 75 percent of the linear distance along the contact element from the contact tail.

17. The electrical connector of claim 16, wherein:

the central region of the intermediate portion of each of the interconnected ones of the second plurality of contact elements comprises a plurality of tabs extending from the housing;

the bridging member comprises a planar, lossy member with a plurality of slots, each of the plurality of slots of the bridging member engages a tab of the plurality of tabs of the interconnected ones of the second plurality of contact elements.

18. The electrical connector of claim 17, wherein:

the bridging member is a first bridging member;

the cavity is a first cavity;

the housing comprises a second cavity;

the electrical connector comprises:

a third plurality of conductive contact elements, each of the third plurality of conductive contact elements comprising:

a contact tail adapted for attachment to the planar substrate;

a mating portion extending through the lower surface of the second cavity; and an intermediate portion connecting the contact tail and the mating portion;

a fourth plurality of conductive contact elements, each of the fourth plurality of conductive contact elements comprising:

a contact tail adapted for attachment to the planar substrate;

a mating portion extending through the upper surface of the second cavity; and an intermediate portion connecting the contact tail and the mating portion; and a second bridging member interconnecting multiple ones of the third plurality of conductive contact elements, the bridging member being at least partially conductive and connected to the intermediate portion of each of the interconnected ones of the third plurality of contact elements.

19. The electrical connector of claim 16, wherein the bridging member is connected to the second segment of the intermediate portion of each of the interconnected ones of the second plurality of contact elements.

20. An electrical connector, comprising:

a housing comprising:

a front face;

a rear face;

a lower face;

a cavity with an opening in the front face shaped to receive a mating connector; and a plurality of slots in the rear face, each of the plurality of slots opening into the cavity;

a plurality of conductive contact elements, each contact element comprising:

a contact tail extending through the lower face, a mating portion and an intermediate portion connecting the contact tail and the mating portion, each of the plurality of contact elements being positioned within the housing with the intermediate portion disposed within a slot of the plurality of slots and the mating portion projecting into the cavity, wherein:

the intermediate portion of each contact element comprises a retention segment, the retention segment comprising a plurality of sub-segments, wherein a first sub-segment of the retention segment extends from the intermediate portion at a first acute angle with respect to a centerline of the intermediate portion and a second sub-segment of the retention segment extends from the intermediate portion at a second acute angle with respect to the centerline of the intermediate portion;

each of the plurality of slots comprising a feature with a shape complementary to the retention segment of a contact element of the plurality of contact elements; and each of the plurality of contact elements is positioned in a slot of the plurality of slots with the retention segment disposed in the feature of the slot.

21. The electrical connector of claim 20, wherein:

for each contact element:

the intermediate portion comprises a first portion and a second portion, transverse to the first portion, the first portion being adjacent the contact tail and the second portion being adjacent the mating portion; and the retention segment comprises a segment of the first portion.

22. The electrical connector of claim 21, wherein the first portion of the intermediate portion of each contact elements is free of barbs.

23. The electrical connector of claim 21, wherein, for each contact element, the width of the contact element is uniform throughout the retention segment.

24. The electrical connector of claim 23, wherein, for each contact element, the second portion comprises a barb extending from an edge adjacent the first portion.

25. The electrical connector of claim 24, wherein, for each contact element, the intermediate portion comprises a transition region between the retention segment and the contact tail, the transition region comprising a region over which the width of the contact element increases.

26. The electrical connector of claim 25, further comprising:

a bridging member disposed adjacent the rear face, the bridging member being at least partially conductive and having a first portion contacting the intermediate portion of a first contact element of the plurality of contact elements and a second portion contacting the intermediate portion of a second contact element of the plurality of contact elements, the first contact element and the second contact element being separated by at least one other contact element of the plurality of contact elements, the at least one other contact element not contacting the bridging member.

27. The electrical connector of claim 26, wherein the cavity and the mating portions of the plurality of contact elements are sized and positioned in accordance with an SFP standard.

28. An electronic assembly, comprising:

a printed circuit board; and a connector mounted to the printed circuit board, the connector comprising:

a housing comprising:

a front face;

a rear face;

a lower face;

a cavity with an opening in the front face shaped to receive a mating connector; and a plurality of conductive contact elements, each contact element comprising:

a contact tail extending through the lower face, the contact tail being attached to the printed circuit board, a mating portion and an intermediate portion connecting the contact tail and the mating portion, each of the plurality of contact elements being positioned within the housing with the mating portion projecting into the cavity, wherein, for each of the plurality of contact elements:

the intermediate portion comprises a first portion and a second portion, transverse to the first portion, the second portion being adjacent the mating portion, and the width of the contact element being uniform over the first portion; and the contact element comprises a transition region between the first portion and the contact tail, the transition region comprising a first region over which the width of the contact element is less than the width in the first portion and a second region over which the width of the contact element increases, the second region over which the width increases being adjacent the contact tail; and a bridging member disposed external to the housing, the bridging member being at least partially conductive and having a first portion contacting the intermediate portion of a first contact element of the plurality of contact elements and a second portion contacting the intermediate portion of a second contact element of the plurality of contact elements, the first contact element and the second contact element being separated by at least one other contact element of the plurality of contact elements, the at least one other contact element not contacting the bridging member.

29. The electronic assembly of claim 28, wherein for each of the plurality of contact elements:

the transition region creates a localized increase in inductive impedance of the contact element; and the contact tail is soldered to a pad on the printed circuit board, creating a localized increase in capacitance impedance of the contact element, whereby the impedance of the contact element is equalized by the inductive impedance offsetting the capacitance impedance.

30. The electronic assembly of claim 28, wherein:

the first portion comprises a retention segment, the retention segment being formed as a jog in the first portion;

the housing comprises a plurality of slots through the rear face, each of the slots comprising a segment complimentary to jog; and each of the plurality of contact elements is positioned within a slot of the plurality of slots with the jog positioned with the segment complimentary to the jog.

31. The electronic assembly of claim 28, wherein the bridging member is connected to the first contact element and the second contact element at a location of the first portion of the intermediate portion between the jog and the second portion.

32. The electronic assembly of claim 31, wherein:

each of the plurality of contact elements comprises a barb extending from the second portion, the barb engaging the housing, the barb of each of the plurality of contact elements extending from an edge of the second portion adjacent the first portion.

33. An electrical connector, comprising:

a housing comprising:

a front face;

a lower face;

a cavity with an opening in the front face, the cavity being shaped to receive a mating connector; and a plurality of slots within the housing;

a plurality of contact elements, each contact element comprising:

a contact tail extending through the lower face, a mating portion and an L-shaped intermediate portion connecting the contact tail and the mating portion, the L-shaped intermediate portion comprising a first portion and a second portion, the second portion being at a right angle relative to the first portion;

wherein:

the first portion of the intermediate portion of each contact element comprises a retention segment of uniform width, the retention segment comprising a first sub-segment and a second sub-segment, the first sub-segment pressing against a wall of a slot of the plurality of slots at a first angle relative a centerline of the intermediate portion, and the second sub-segment pressing against a wall of the slot at a second angle relative a centerline of the intermediate portion, the first angle being different than the second angle.

34. The electrical connector of claim 33, wherein, for each contact element, the first angle and the second angle are supplementary angles.

35. The electrical connector of claim 33, wherein, for each contact element, the first portion is free of barbs.

36. The electrical connector claim 35, wherein, for each contact element, the second portion comprises a barb on an edge of the second portion, the edge of the second portion being adjacent the first portion.

37. The electrical connector of claim 36, wherein, for each contact element, the first portion is separated from the contact tail by a transition region, the transition region comprising a region over which the width of the contact element increases.

* * * * *